US010643565B2

(12) United States Patent
Park et al.

(10) Patent No.: US 10,643,565 B2
(45) Date of Patent: May 5, 2020

(54) DISPLAY DEVICE AND MOBILE TERMINAL USING THE SAME

(71) Applicant: LG Display Co., Ltd., Seoul (KR)

(72) Inventors: Kwanwoong Park, Gumi-si (KR); Sanghoon Kwon, Daegu (KR); Jongyoon Kim, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 220 days.

(21) Appl. No.: 14/981,850

(22) Filed: Dec. 28, 2015

(65) Prior Publication Data

US 2017/0004798 A1 Jan. 5, 2017

(30) Foreign Application Priority Data

Jun. 30, 2015 (KR) ..... 10-2015-0093670

(51) Int. Cl.
*G09G 3/34* (2006.01)
*G09G 3/36* (2006.01)

(52) U.S. Cl.
CPC ..... *G09G 3/3688* (2013.01); *G09G 3/3406* (2013.01); *G09G 3/3648* (2013.01);
(Continued)

(58) Field of Classification Search
CPC ..... G09G 3/3648; G09G 3/34; G09G 3/3688; G09G 3/3677; G09G 3/3666; G09G 3/3406; G09G 3/3696; G09G 2330/021; G09G 2320/0247; G09G 2360/04; G09G 2360/16; G09G 2310/0297; G09G 2310/04;
(Continued)

(56) References Cited

U.S. PATENT DOCUMENTS 6,788,277 B2 * 9/2004 Kanauchi ..... G09G 3/3266 315/169.2
7,116,307 B2 * 10/2006 Toyozawa ..... G09G 3/20 345/100
(Continued)

FOREIGN PATENT DOCUMENTS

CN 1152591 C 6/2004
CN 100533533 C 8/2009
(Continued)

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*
(Continued)

*Primary Examiner* — Jeff Piziali
(74) *Attorney, Agent, or Firm* — Fenwick & West LLP

(57) ABSTRACT

A display device and a mobile terminal include a main display unit and an auxiliary display unit that are driven in a full display mode or an always-on mode. The display device includes a data driver configured to supply a data voltage to the data lines, a first gate driver connected to gate lines of the main display unit, and a second gate driver connected to gate lines of the auxiliary display unit. In the full display mode, at least a portion of the main display unit and the auxiliary display unit display image data. In the always-on mode, at least a portion of the auxiliary display unit displays image data.

24 Claims, 22 Drawing Sheets

(52) U.S. Cl.
CPC ..... *G09G 3/3666* (2013.01); *G09G 3/3677* (2013.01); *G09G 3/3696* (2013.01); *G09G 2300/0408* (2013.01); *G09G 2300/0478* (2013.01); *G09G 2310/0297* (2013.01); *G09G 2310/04* (2013.01); *G09G 2320/0247* (2013.01); *G09G 2320/0686* (2013.01); *G09G 2330/021* (2013.01); *G09G 2340/0435* (2013.01); *G09G 2360/04* (2013.01); *G09G 2360/16* (2013.01)

(58) Field of Classification Search
CPC ... G09G 2320/0686; G09G 2340/0435; G09G 2300/0408; G09G 2300/0478
See application file for complete search history.

(56) References Cited

U.S. PATENT DOCUMENTS

| | | | | |
|---|---|---|---|---|
| 7,126,595 | B2 * | 10/2006 | Yanagi | G09G 3/3696 345/211 |
| 7,911,434 | B2 * | 3/2011 | Toyozawa | G09G 3/20 345/87 |
| 8,154,498 | B2 * | 4/2012 | Katayama | G09G 3/3688 345/100 |
| 8,896,504 | B2 * | 11/2014 | Park | G09G 3/3233 345/76 |
| 9,436,970 | B2 * | 9/2016 | Connell | G06T 1/20 |
| 2001/0020939 | A1 * | 9/2001 | Ikeda | G09G 3/3696 345/211 |
| 2002/0036636 | A1 * | 3/2002 | Yanagi | G09G 3/3696 345/211 |
| 2003/0197472 | A1 | 10/2003 | Kanauchi et al. | |
| 2004/0041777 | A1 * | 3/2004 | Toyozawa | G09G 3/20 345/100 |
| 2006/0227122 | A1 | 10/2006 | Proctor | |
| 2007/0063958 | A1 | 3/2007 | Toyozawa et al. | |
| 2007/0091050 | A1 | 4/2007 | Katayama et al. | |
| 2011/0025670 | A1 * | 2/2011 | Park | G09G 3/3233 345/211 |
| 2012/0113078 | A1 * | 5/2012 | Kwon | G09G 3/3233 345/211 |
| 2014/0184471 | A1 * | 7/2014 | Martynov | G06F 3/1423 345/1.2 |
| 2014/0267316 | A1 | 9/2014 | Connell et al. | |
| 2015/0089636 | A1 * | 3/2015 | Martynov | G06F 3/1423 726/19 |

FOREIGN PATENT DOCUMENTS

| | | | |
|---|---|---|---|
| CN | 101996573 | A | 3/2011 |
| CN | 102237050 | A | 11/2011 |
| EP | 1180762 | A2 | 2/2002 |
| EP | 1437708 | A1 | 7/2004 |
| EP | 2284826 | A1 | 2/2011 |
| WO | WO 2014/088469 | A1 | 6/2014 |

OTHER PUBLICATIONS

European Extended Search Report, European Application No. 15203080.5, dated Feb. 15, 2017, 25 pages.
European Partial Search Report, European Application No. 15203080.5, dated Nov. 22, 2016, 10 pages.
First Office Action, State Intellectual Property Office of the People's Republic of China Patent Application No. 201511019715.2, dated Jul. 25, 2018, 14 pages.

* cited by examiner

<Always on mode>

<Full Display mode>

DISPLAY DEVICE AND MOBILE TERMINAL USING THE SAME

This application claims the benefit of Korean Patent Application No. 10-2015-0093670 filed on Jun. 30, 2015, the entire contents of which is incorporated herein by reference for all purposes as if fully set forth herein.

BACKGROUND

Field of the Invention

The present disclosure relates to a display device in which information is constantly displayed on a portion of a screen.

Discussion of the Related Art

Various flat display devices such as a liquid crystal display (LCD), an organic light emitting display device, a plasma display panel (PDP), and an electrophoretic display (EPD) have been developed. An LCD displays an image by controlling an electric field applied to liquid crystal molecules according to a data voltage. In an active matrix (AM) mode LCD, a pixel contains a thin film transistor (TFT).

An LCD includes a liquid crystal display panel, a backlight unit irradiating light to the liquid crystal display panel, a source drive integrated circuit (IC) supplying a data voltage to data lines of the liquid crystal display panel, a gate drive IC supplying a gate pulse (or scan pulse) to gate lines of the liquid crystal display panel, a control circuit controlling the ICs, and a light source driving circuit driving a light source of the backlight unit.

Mobile terminals include a cellular phone, a smartphone, a tablet computer, a notebook computer, a wearable device, and the like. In general, a mobile terminal stops driving of a display device in order to reduce power consumption in an idle mode. Thus, a user should restart the mobile terminal when he or she wants to view required information.

SUMMARY

An aspect of the present disclosure provides a display device that reduces power consumption to display information, and a mobile terminal using the same.

In an aspect, a display device includes a display panel in which pixel arrays include pixels that are disposed in a matrix form according to an intersection structure of data lines and gate lines. The pixel arrays are divided into a main display unit and an auxiliary display unit. The display device further includes a data driver configured to supply a data voltage to the data lines, a first gate driver connected to gate lines of the main display unit, and a second gate driver connected to gate lines of the auxiliary display unit.

The main display unit and an auxiliary display unit may be contiguously formed on a common substrate such that they share at least one common edge, such as a common horizontal or vertical edge. For example, the main display unit and the auxiliary display unit are both connected to the data driver through one or more shared data lines. A shared data line may charge display data to pixels in both the main display unit and the auxiliary display unit during different horizontal periods. As another example, the main display unit and the auxiliary display unit share a common lower substrate, a common upper substrate, and a common continuous liquid crystal layer between the lower substrate and the upper substrate.

In a full display mode, the first gate driver supplies gate pulses to the gate lines of the main display unit, and the second gate driver supplies gate pulses to the gate lines of the auxiliary display unit.

In an always-on mode, the first gate driver fixes a voltage of the gate lines of the main display unit to a preset low polarity voltage, such as a low voltage less than a ground voltage, and the second gate driver supplies gate pulses to the gate lines of the auxiliary display unit. For example, the preset low voltage is a gate low voltage having negative polarity, where the gate pulses supplied by the first gate driver rise from the gate low voltage to a gate high voltage before falling back to the gate low voltage.

In another aspect, a mobile terminal includes a display module having the display panel, the data driver, the first gate driver, and the second gate driver. Also, the mobile terminal includes a host system transmitting data of an input image to the display module.

BRIEF DESCRIPTION OF THE DRAWINGS

The accompanying drawings, which are included to provide a further understanding of the present disclosure and are incorporated in and constitute a part of this specification, illustrate embodiments of the present disclosure and together with the description serve to explain the principles of the present disclosure. In the drawings.

DETAILED DESCRIPTION OF THE EMBODIMENTS

Figure 1:
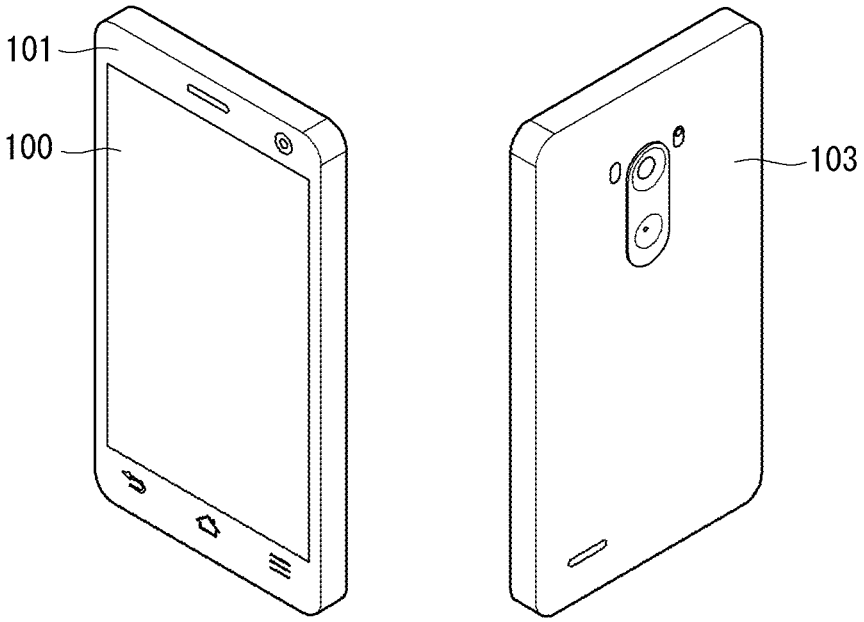
FIGS. 1 and 2 are views schematically illustrating a mobile terminal according to an embodiment of the present disclosure.

Hereinafter, embodiments of the present disclosure will be described with reference to the accompanying drawings. Like reference numerals refer to like elements throughout. In the description of the present disclosure, when it is determined that the detailed description of the related art would obscure the gist of the present disclosure, the description thereof will be omitted.

Figure 2:
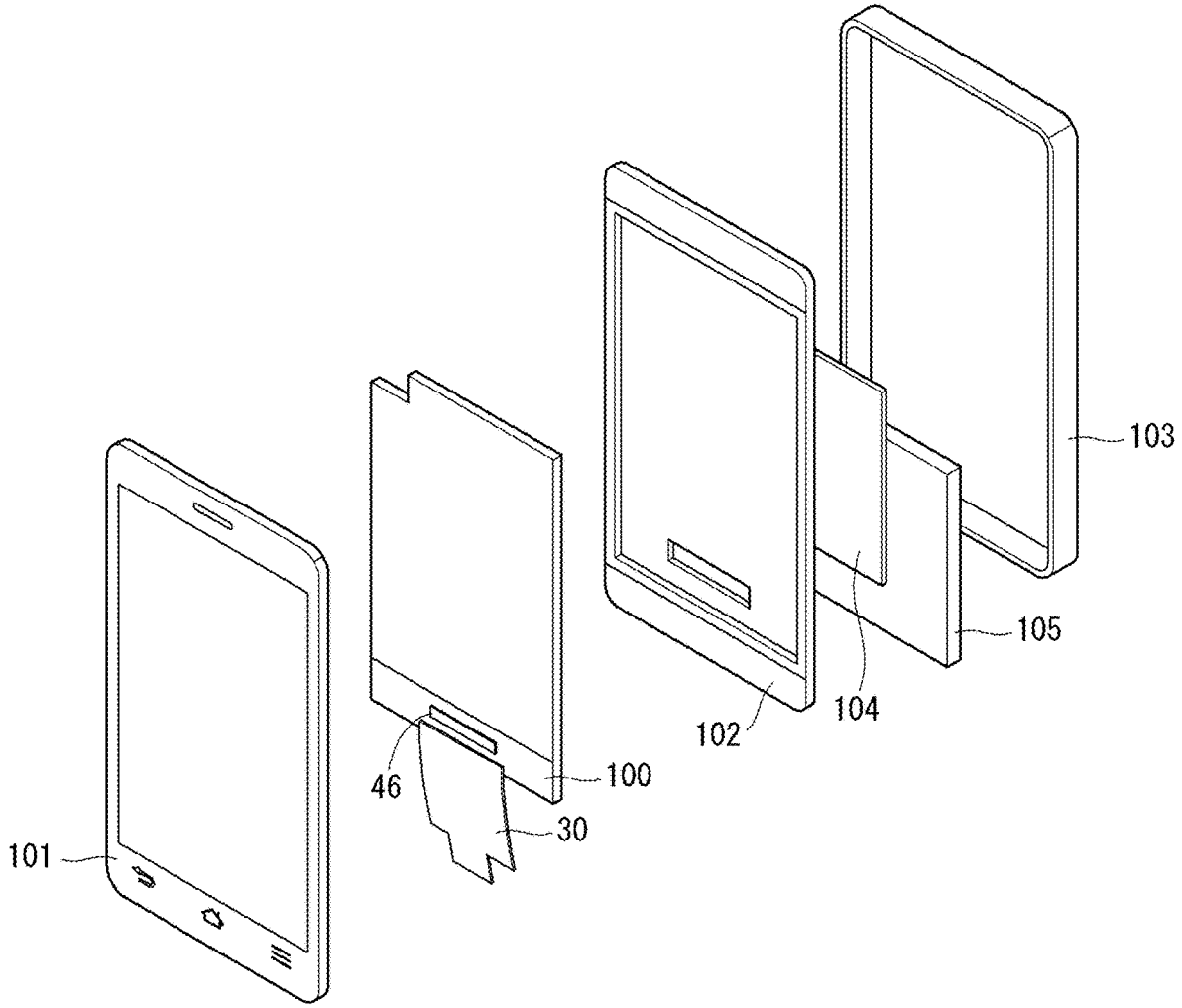

FIGS. 1 and 2 are views schematically illustrating a mobile terminal according to an embodiment of the present disclosure. In FIGS. 1 and 2, a bar phone-type terminal having a full touch screen structure is illustrated, but the present disclosure is not limited thereto.

Referring to FIGS. 1 and 2, a mobile terminal according to an embodiment of the present disclosure includes a display module, a front cover 101, a back cover 103, a middle frame 102, a main board 104, and a battery 105. Here, the "cover" may also be referred to as a case or a housing.

The display device according to an embodiment of the present disclosure may be implemented as a flat display device such as a liquid crystal display (LCD) device or an organic light emitting display device. A display module includes a display panel 100 of the flat display device and a display panel driving circuit for driving the display panel 100. In the display panel 100, touch sensors may be disposed throughout the screen. The display panel driving circuit includes a drive integrated circuit (IC) 46 and a flexible circuit board 30 connecting the drive IC 46 to the main board 104. The drive IC 46 writes image data input through the main board 104 to pixels of the display panel 100. The flexible circuit board 30 may be any one of a flexible printed circuit board (FPCB) and a flexible flat cable (FFC).

Tempered glass may be disposed on the front cover 101 to cover the display panel 100. The front cover 101 covers a front surface of the mobile terminal. A screen of the display panel 100 is exposed to the front surface of the mobile terminal. A front camera and various sensors may be disposed on the front surface of the mobile terminal. A rear camera and various sensors may be disposed on a rear surface of the mobile terminal. The sensors may include various sensors that may be applied to a mobile terminal, for example, a proximity sensor, a gyro sensor, a geomagnetic sensor, a motion sensor, an illumination sensor, an RGB sensor, a Hall effect sensor, a temperature/humidity sensor, a heartbeat sensor, and a fingerprint recognition sensor.

The display module, the middle frame 102, the main board 104, and the battery 105 are disposed in a space between the front cover 101 and the back cover 103. The middle frame 102 supports the display panel 100 and spatially separates the display panel 100 and the main board 104. The flexible circuit board 30 of the display module is connected to the main board 104 through a slot of the middle frame 102. An audio/video (A/V) input unit, a user input unit, a speaker, and a microphone are installed in the front cover 101 and the back cover 103. The A/V input unit, the user input unit, the speaker, and the microphone are connected to the main board 104. The user input unit may be configured as a touch keypad, a dome switch, a touch pad, a jog wheel, or a jog switch.

Circuits of a host system HOST (200 in FIG. 4) are mounted on the main board 104. The host system HOST 200 includes a display module, a wireless communication module, a short-range communication module, a mobile communication module, a broadcast receiving module, an A/V input unit, a global positioning system (GPS) module, and a power circuit. A user input unit, a speaker, a microphone, and a battery 105 are connected to the host system HOST 200. The power circuit cancels noise from a voltage in a battery 105 and supplies the noise-canceled voltage to a module power supply unit of the display panel driving circuit. In this embodiment, the host system HOST 200 is illustrated as a phone system, but the present disclosure is not limited thereto. For example, the display device of the present disclosure may also be applied to a television (TV) system, a set-top box (STB), a navigation system, a DVD player, a Blu-ray player, a personal computer (PC), and a home theater system.

Figure 3:
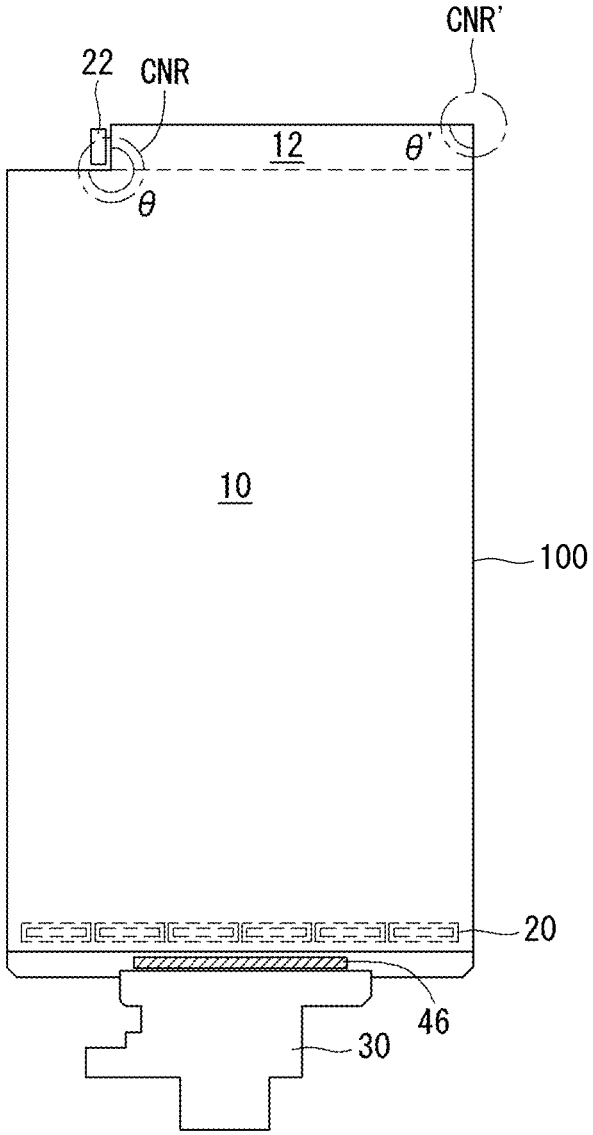
FIG. 3 is a plan view specifically illustrating a display module illustrated in FIG. 2.
Figure 4:
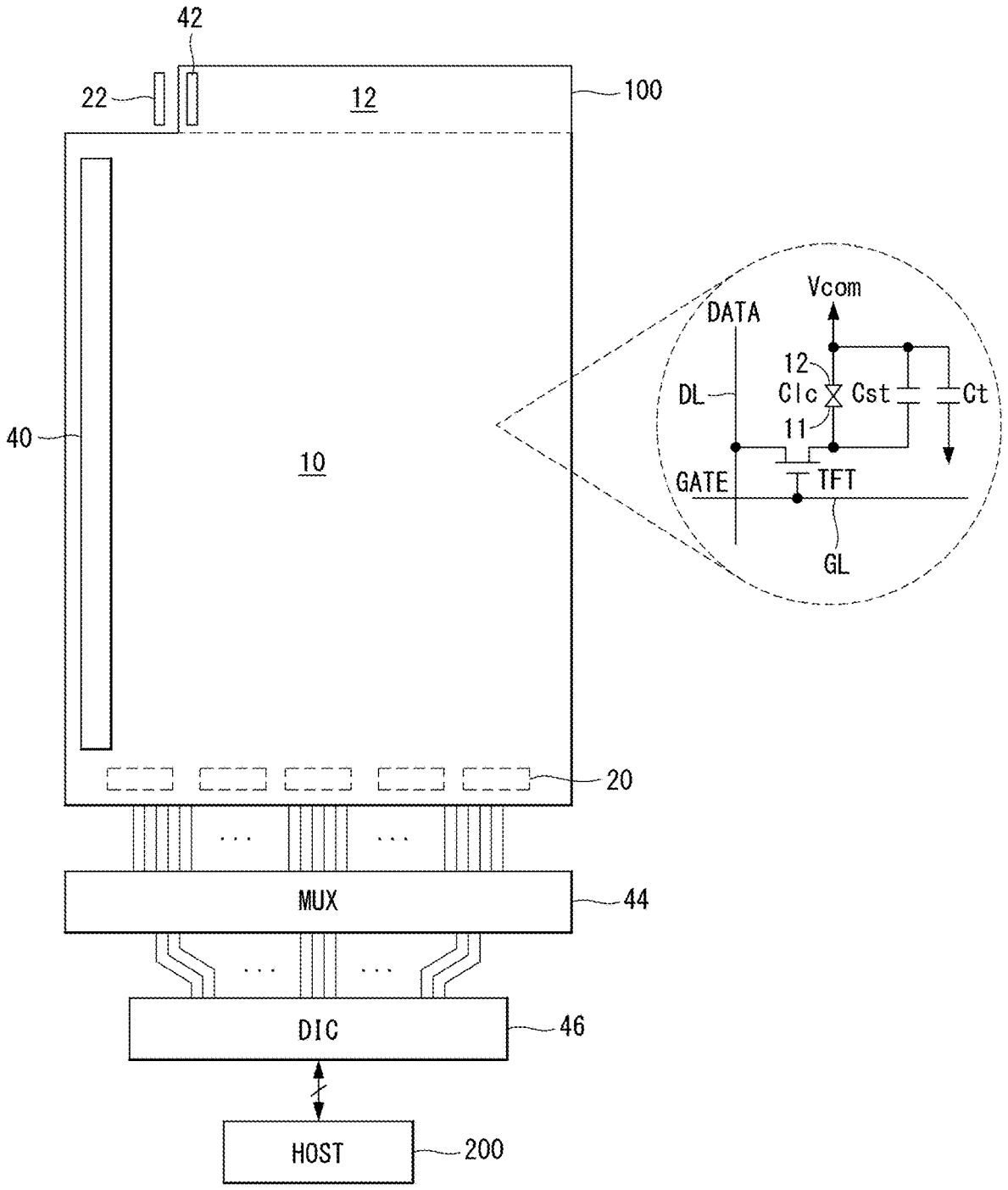
FIG. 4 is a view illustrating a display panel driving circuit according to an embodiment of the present disclosure.

FIGS. 3 and 4 are views illustrating a display module according to an embodiment of the present disclosure.

Referring to FIGS. 3 and 4, the display panel 100 may be manufactured to have an approximately rectangular shape, but the present disclosure is not limited thereto. The display panel 100 has at least one concave corner portion CNR among corner portions where two edges of the display panel intersect. The concave corner portion CNR has an internal angle (0) greater than 180° and less than or equal to 300°. The concave corner portion CNR may have a chamfered form. One or more sensors such as a front camera, or other sensor may be disposed in the space secured by the concave corner portion CNR. For example, the one or more sensors are disposed in an area bounded on two sides by the display panel, where the two sides meet at the convex corner portion CNR.

The display panel 100 may include one or more convex corner portions CNR'. The convex corner portion CNR' may have an angle of about 90° (e.g., between 45° and 135°).

A screen of the display panel 100 includes a pixel array displaying an input image. The screen includes a main display unit 10 and an auxiliary display unit 12. The main display unit 10 is disposed below the concave corner portion CNR.

The auxiliary display unit 10 is disposed between two corner portions CNR and CNR'. In an embodiment, the auxiliary display unit 12 is disposed above the main display unit 12, but the present disclosure is not limited thereto. The auxiliary display unit 10 is not limited to that of FIGS. 3 and 4.

Figure 25:
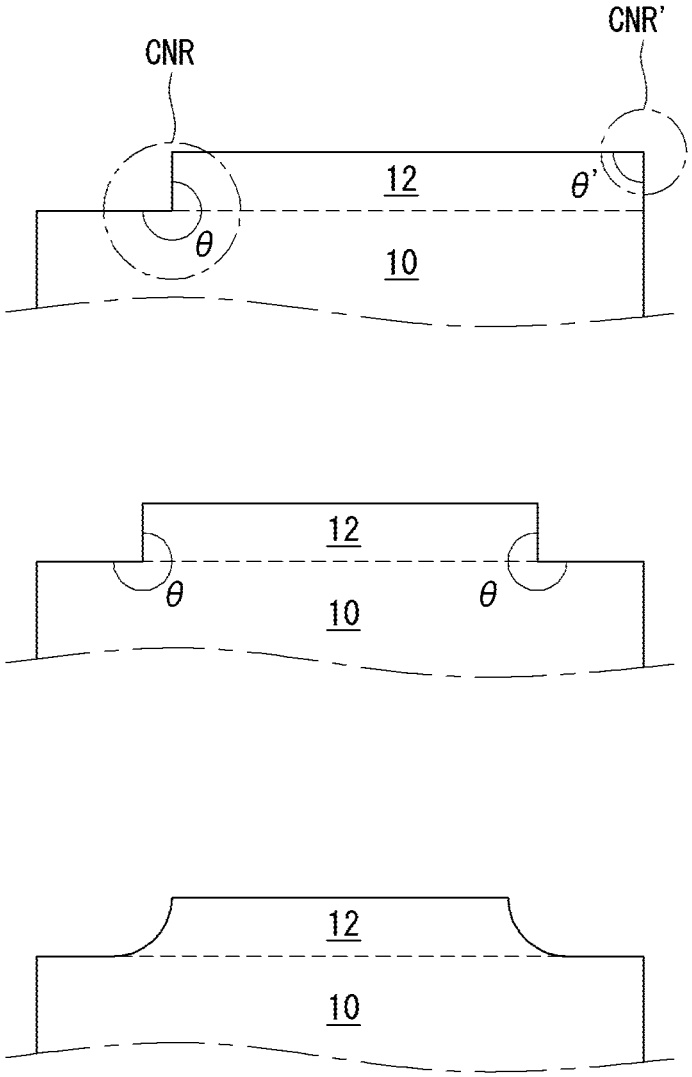
FIG. 25 is a view illustrating various types of auxiliary display units according to an embodiment of the present disclosure.

The auxiliary display unit 10 may be implemented to have various shapes as illustrated in FIG. 25. In the first example, the auxiliary display unit 12 is less wide than the main display unit 10 and is offset to one side of the main display unit 10. One side of the auxiliary display unit 12 is aligned with a parallel side of the main display unit 10, and the opposite side of the auxiliary display unit 12 is offset from the opposite side of the main display unit 10 to form the concave corner CNR. In the second example, the auxiliary display unit 12 is less wide than the main display unit 10 and may share a common central axis with the main display unit 10. Two opposite sides of the auxiliary display unit 12 are offset from corresponding opposite sides of the main display unit 10 that are parallel to the opposite sides of the auxiliary display unit 12. Thus, the auxiliary display unit 12 forms two concave corners CNR with the main display unit 10. One or more sensors may be placed to either side of the auxiliary display unit 12 in an area bounded by one of the opposite sides of the auxiliary display unit 12 and a perpendicular side of the main display unit 10 adjacent to the auxiliary display unit 10. In the third example, the auxiliary display unit 12 has a similar position relative to the main display unit 10 as in the second example, but the concave corners CNR are rounded.

The auxiliary display unit 10 displays data in a full display mode and an always-on mode. Data displayed in the auxiliary display unit 10 may be data that may be frequently viewed by a user, for example, a communication state, a battery power state, a social network service (SNS) message, an e-mail message, and a clock. The data may be selected by the user.

In the related art, all the corner portions of the display panel 100 are processed to have an internal angle of 90° and black matrices are removed from the corner portions where a camera or sensors are disposed. In the related art, pixel arrays are formed only in the main display unit 10. In the display panel of the related art, since pixels are not formed between both corner portions where a camera or a sensor is disposed, an image may not be displayed. In contrast, in the present disclosure, an image display unit may be extended to the auxiliary display unit 12 by optimizing a driving circuit for driving pixel arrays formed in the auxiliary display unit 12.

The main display unit 10 displays input image data in the full display mode, and is not driven in the always-on mode in order to reduce power consumption. Thus, the main display unit 10 stops operation in the always-on mode.

The display panel 100 includes an upper substrate and a lower substrate facing each other with a liquid crystal layer LC interposed therebetween. The main display unit 10 and the auxiliary display unit 12 may include pixels formed from a common lower substrate, upper substrate, and/or liquid crystal layer LC. The pixel array of the display panel 100 includes pixels arranged in a matrix form by an intersection structure of data lines DL and gate lines GL. The pixel array is divided into a main display unit 10 and the auxiliary display unit 12. The data lines DL are connected to pixels of the main display unit 10 and pixels of the auxiliary display unit 12 by traversing the main display unit 10 and the auxiliary display unit 12. The gate line GL are divided into gate lines GL connected to the pixels of the main display unit 10 and gate lines GL connected to the pixels of the auxiliary display unit 12.

A TFT array may be formed in the lower substrate of the display panel 100. The TFT array includes data lines DL, gate lines GL, TFTs formed in intersections of the data lines DL and the gate lines GL, pixel electrodes 11 connected to the TFTs, and storage capacitors Cst connected to the pixel electrodes 11. The TFTs may be implemented using amorphous silicon (a-Si) TFTs, low-temperature polysilicon (LTPS) TFTs, or oxide TFTs. TFTs are connected to pixel electrodes of subpixels in a one-to-one manner. In FIG. 4, Clc denotes capacitance of the liquid crystal layer between the pixel electrode 11 and the common electrode 12.

The TFT is a switching element supplying a data voltage applied through the data line DL to the pixel electrode 11 in response to a gate pulse from the gate line GL. The pixels display an input image by adjusting a transmission amount of light using liquid crystal molecules driven by a voltage difference between the pixel electrode to which a data voltage is supplied and the common electrode 12 to which a common voltage Vcom is applied through the TFT.

In FIG. 4, "Ct" denotes an in-cell touch sensor installed in the pixel array. The in-cell touch sensor Ct may be implemented as a capacitance-type touch sensor. The capacitance type touch sensor may be a self-capacitance-type touch sensor or a mutual-capacitance-type touch sensor. The in-cell touch sensor Ct is coupled to the signal lines DL and GL and the pixel electrode 12 of the pixels, and thus, a signal applied to the pixels may act as noise. In order to reduce a mutual influence of the pixels and the touch sensors, a frame period of the display panel is divided into a display period during which data of an input image is written to pixels and a touch sensing period during which the touch sensors are driven. The common electrode 12 is divided into electrodes of the in-cell touch sensors and supplies a common voltage Vcom as a reference voltage of the pixels during the display period and supplies an electric charge to the in-cell touch sensors during the touch sensing period.

A color filter array may be formed on the upper substrate of the display panel 100. The color filter array includes a black matrix BM and a color filter CF. The common electrode 12 may be formed on the upper substrate in a vertical field driving mode such as a twisted nematic (TN) mode and a vertical alignment (VA) mode, and formed on the lower substrate together with the pixel electrode 11 in a horizontal field driving mode such as an in-plane switching (IPS) mode or a fringe field switching (FFS) mode.

A polarizer is attached to the upper substrate and to the lower substrate of the display panel 100. An alignment layer for setting a pre-tilt angle of liquid crystal is formed. A spacer is disposed between the upper substrate and the lower substrate to maintain a cell gap of the liquid crystal layer.

The display device according to an embodiment of the present disclosure may further include a backlight unit for evenly irradiating light to the display panel 100. The display device according to an embodiment of the present disclosure may be implemented in any type of LCD device, such as a transmissive LCD device, a translucent LCD device, or a reflective LCD device. The transmissive LCD device and the translucent LCD device require a backlight unit. The backlight unit may be implemented as a direct type backlight unit or an edge type backlight unit.

Figure 21:
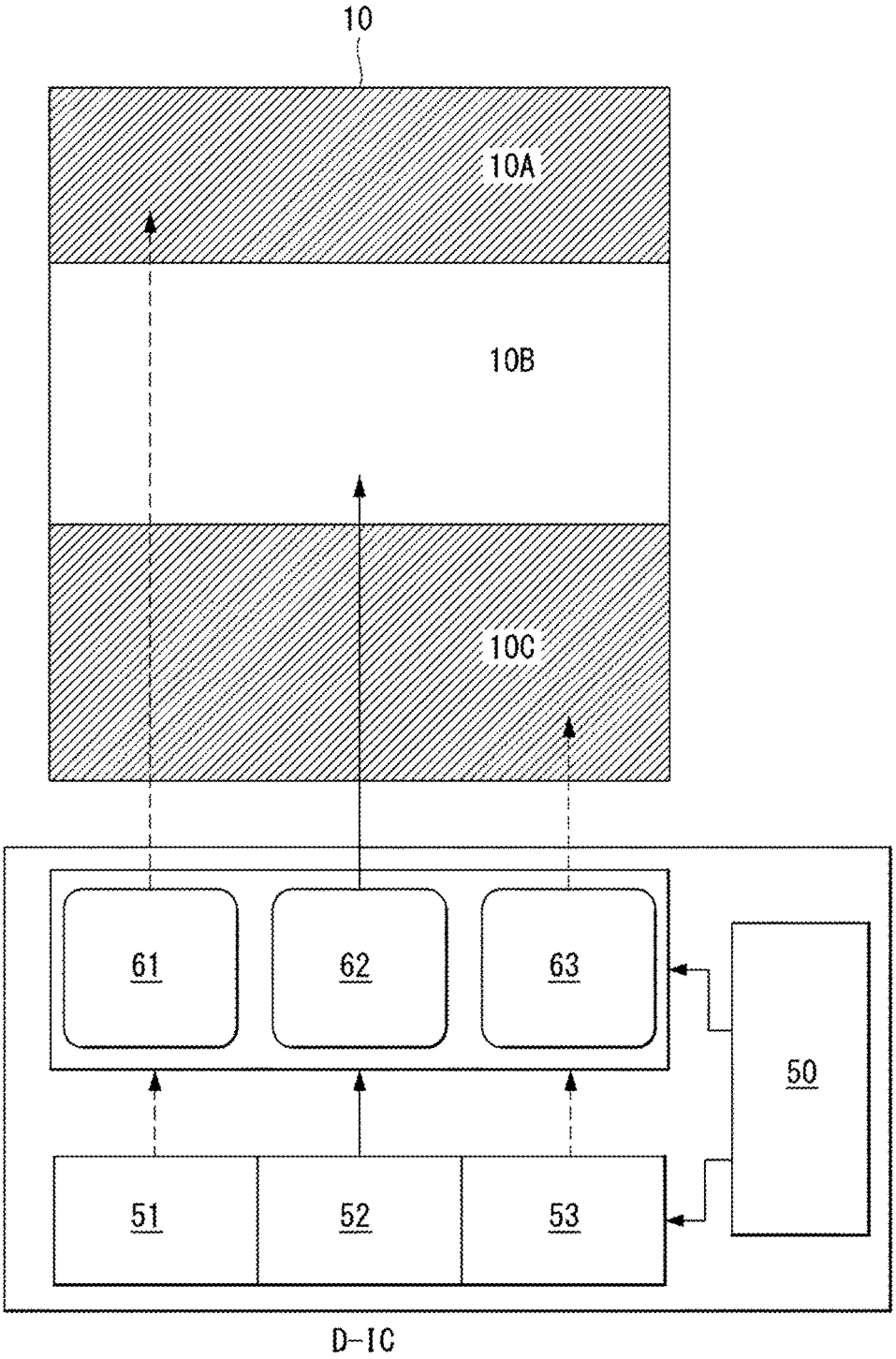
FIG. 21 is a view illustrating a method for driving a display device according to a fifth embodiment of the present disclosure.
Figure 23:
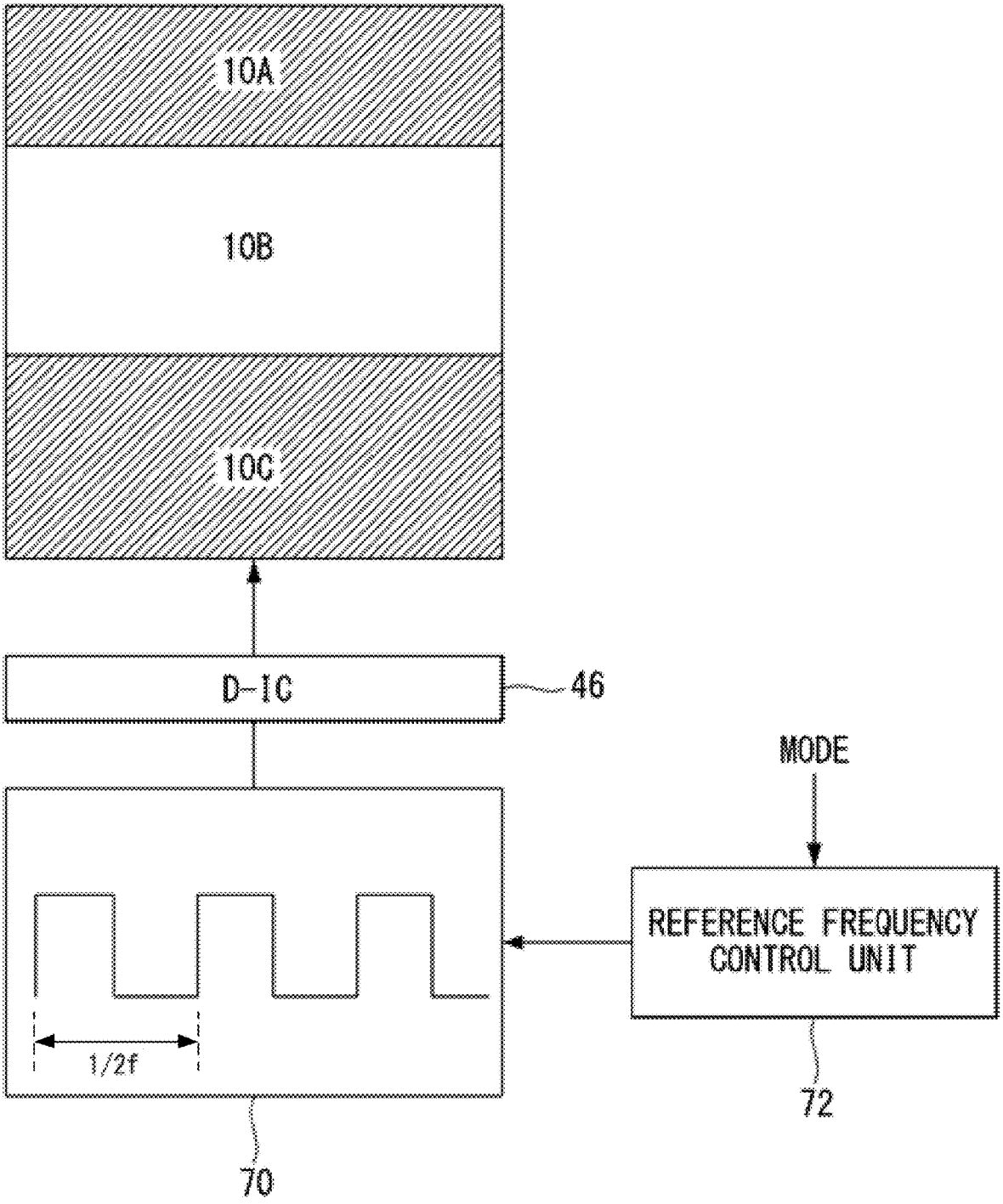
FIG. 23 is a view illustrating a method for driving a display device according to a sixth embodiment of the present disclosure.

The display panel driving circuit writes data of an input image into pixels. The display panel driving circuit includes a data driver, a gate driver, a timing controller, and a module power supply unit. The display panel driving circuit may include memories 61 to 63, memory power switching units 51 to 53, and a memory control unit 50 as illustrated in FIG. 21. Also, the display panel driving circuit may further include a reference frequency control unit 72 and a reference frequency generating unit 70 as illustrated in FIG. 23. The display panel driving circuit may be integrated in a drive IC 46.

The display panel driving circuit may further include a backlight driving unit. The backlight driving unit adjusts backlight luminance by varying a duty ratio of a dimming signal according to an input image. The dimming signal is generated as a pulse width modulation (PWM) signal.

Upon receiving image data output from the timing controller, the data driver converts the image data into positive polarity or negative polarity gamma compensation voltage to output a positive polarity or negative polarity data voltage, respectively. The data voltage is supplied to the data lines DL.

Figure 5:
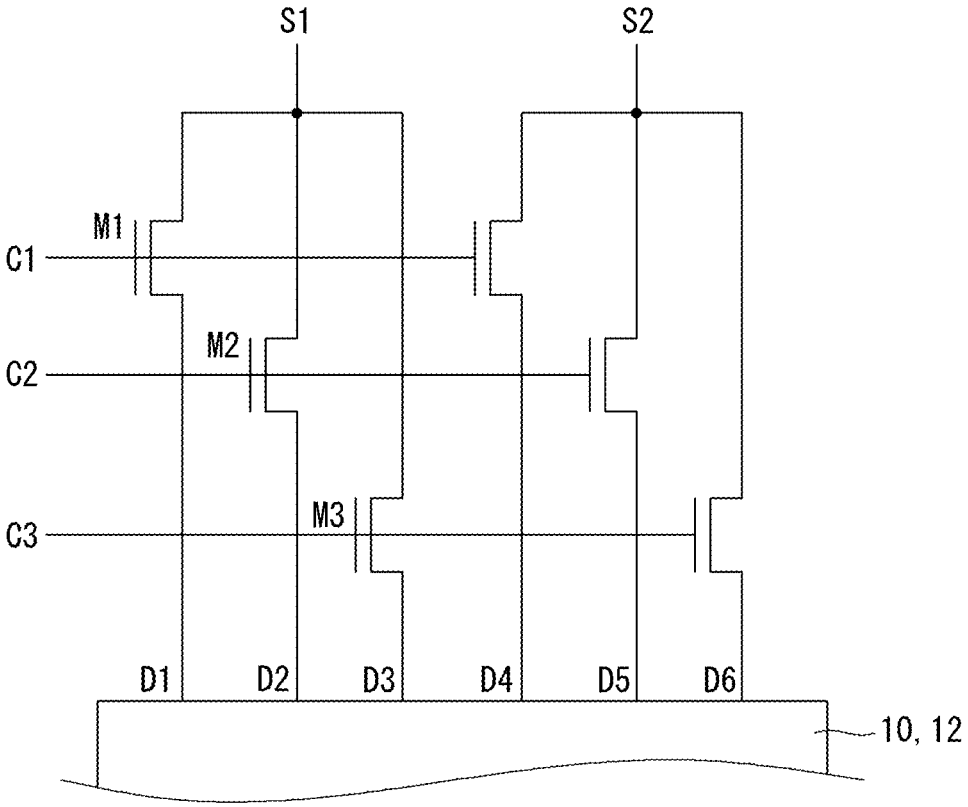
FIG. 5 is a view illustrating an example of a multiplexer illustrated in FIG. 4.

A multiplexer MUX may be disposed between the data driver and the data lines DL. The multiplexer 44 is formed on a substrate SUBS of the display panel 100 or may be installed in the drive IC 46. The multiplexer 44 distributes a data voltage input from the data driver to the data lines DL under the control of the timing controller. A 1:3 multiplexer as illustrated in FIG. 5 time-divides a data voltage input through a single output channel (e.g., Si) of the data driver and supplies the data voltage to three data lines (e.g., D1 through D3). Thus, when the 1:3 multiplexer is used, the number of channels of the drive IC may be reduced by a factor of ⅓. In FIG. 5, M1 to M3 are TFTs of the multiplexer 44, and C1 to C3 are multiplexer (MUX) selection signals output from the timing controller. The TFTs M1 to M3 supply a data voltage to the data lines D1 through D3 in response to the MUX selection signals C1 to C3.

The data driver and the multiplexer 44 may supply only a data voltage to be displayed in the pixels of the auxiliary display unit 12 to the data lines DL in the always-on mode under the control of the timing controller. The data driver and the multiplexer 44 supply a data voltage to be displayed in the pixels of the main display unit 10 and the auxiliary display unit 12 to the data lines DL in the full display mode under the control of the timing controller.

The gate drivers 40 and 42 sequentially supply gate pulses to the gate lines under the control of the timing controller. The gate pulses output from the gate drivers 40 and 42 are synchronized with the data voltage. The gate drivers 40 and 42 may be directly formed on the lower substrate of the display panel 100 together with the pixel array through a gate-in-panel (GIP) process as illustrated in FIG. 4. The gate drivers 40 and 42 include a main gate driver 40 supplying a gate pulse to the gate lines GL of the main display unit 10 and an auxiliary gate driver 42 supplying a gate pulse to the gate lines GL of the auxiliary display unit 12. A timing controller may control the main gate driver 40 and the auxiliary gate driver 42. In the always-on mode, the main gate driver 10 does not operate and the auxiliary gate driver 42 operates to supply a gate pulse to the gate lines of the auxiliary display unit 12. In the full display mode, the main gate driver 40 and the auxiliary gate driver 42 operate to supply a gate pulse to the gate lines of the main display unit 10 and the auxiliary display unit 12.

The timing controller receives timing signals synchronized with data of an input image. The timing signals include a vertical synchronization signal Vsync, a horizontal synchronization signal Hsync, a data enable signal DE, and a main clock CLK. The timing controller controls an operation timing of the data driver, the gate drivers 40 and 42, and the multiplexer 44 on the basis of the timing signals Vsync, Hsync, DE, and CLK. The timing controller may change a reference frequency according to a mode signal input from the host system 200 to lower a driving voltage supplied to the display panel or lower a frame rate in the always-on mode to reduce power consumption.

The module power supply unit includes a DC-DC converter. The module power supply unit may adjust an input voltage from the host system 200 to generate a driving voltage of the display panel 100. The DC-DC converter generates positive polarity and negative polarity gamma voltages VDH and VDL, a gate high voltage VGH, a gate low voltage VGL, a common voltage Vcom, and logic source voltage Vcc by using a PWM circuit, a boost converter, a regulator, and a charge pump. The logic source voltage Vcc is a driving voltage of the driver IC 46. The gate high voltage VGH is a high voltage of a gate pulse set to be greater than or equal to a threshold voltage of TFTs formed in the pixel array and the gate driver 40, and the gate low voltage VGL is a low voltage of a gate pulse set to be less than the threshold voltage of the TFTs. The common voltage Vcom is supplied to the common electrode 12 of the liquid crystal cells Clc. The positive polarity and negative polarity gamma voltages VDH and VDL are divided by gray levels by a dividing circuit and input to a digital-to-analog converter (DAC) of the data driver. The DAC generates a data voltage by selecting a voltage level of the positive polarity or negative polarity gamma voltages according to digital data. The module power supply unit may adjust an output voltage by varying a frequency (or a step-up frequency) of a PWM signal according to a reference frequency input from the timing controller.

The host system 200 may be a phone system, but the present disclosure is not limited thereto. For example, the host system 200 may be any one of a television (TV)) system, an STB, a navigation system, a DVD player, a Blu-ray player, a PC, a home theater system, or a phone system. The host system 200 may transmit image data to the drive IC 46 of the display module. The host system 200 may control the display module to the always-on mode according to a user input. The host system may receive a user input through a user input unit, a graphic user interface (GUI), or a touch UI.

The backlight unit includes a plurality of light sources. The light sources may be implemented as light emitting diodes (LEDs). The light sources may include a main light source 20 irradiating light to the main display unit 10 and an auxiliary light source 22 irradiating light to the auxiliary display unit 12. The backlight driving unit may individually control the light sources 20 and 22 in response to a mode signal. The auxiliary light source 22 may be disposed in a concave space secured by the concave corner portion CNR. In the always-on mode, the backlight driving unit turns off the main light source 20 and turns on the auxiliary light source 22 to irradiate light to the auxiliary display unit 12. In the full display mode, the backlight driving unit may turns on the light sources 20 and 22 to irradiate light to the main display unit 10 and the auxiliary display unit 12.

Figure 6:
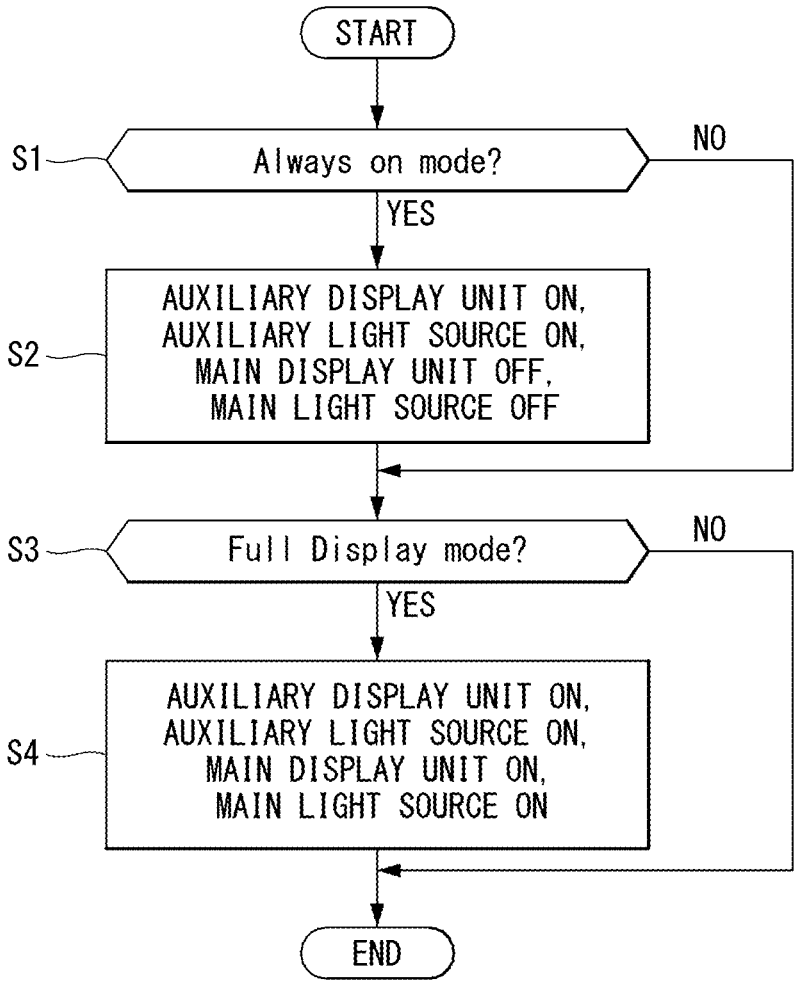
FIG. 6 is a flow chart illustrating a method for controlling a display device according to an embodiment of the present disclosure.
Figure 7:
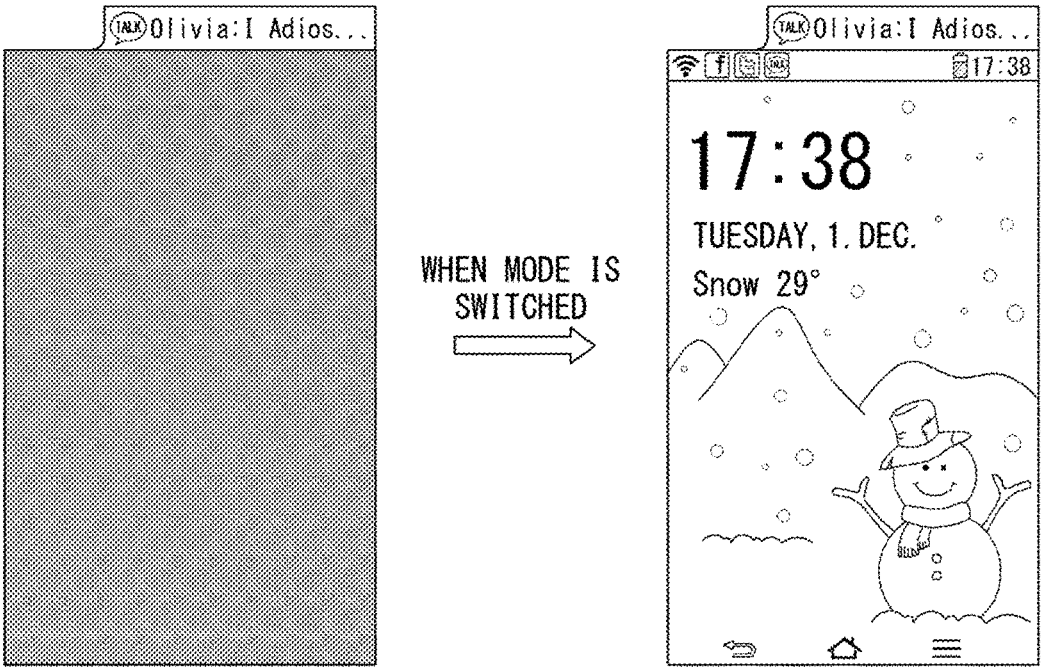
FIG. 7 is a view illustrating operations of a display device in an always-on mode and in a full display mode according to an embodiment of the present disclosure.

FIG. 6 is a flow chart illustrating a method for controlling a display device according to an embodiment of the present disclosure. FIG. 7 is a view illustrating operations of a display device in the always-on mode and in the full display mode according to an embodiment of the present disclosure.

Referring to FIGS. 6 and 7, in the display device according to an embodiment of the present disclosure, the pixels of the auxiliary display unit 12 and the auxiliary light source 22 are driven in the always-on mode, while pixels of the main display unit 10 and the main light source 20 are not driven (steps S1 and S2). In the always-on mode, the display panel driving circuit writes data to the pixels of the auxiliary display unit 12 and updates the pixels of the auxiliary display unit 12. In the always-on mode, the backlight driving unit turns on only the auxiliary light source 22. The display panel driving circuit and the backlight driving unit may determine a driving mode according to a mode signal received from the host system 200.

In the display device according to an embodiment of the present disclosure, in the full display mode, data is written to the pixels of the main display unit 10 and the auxiliary display unit 12 and the main light source 20 and the auxiliary light source 22 are turned on (steps S3 and S4).

Figure 8:
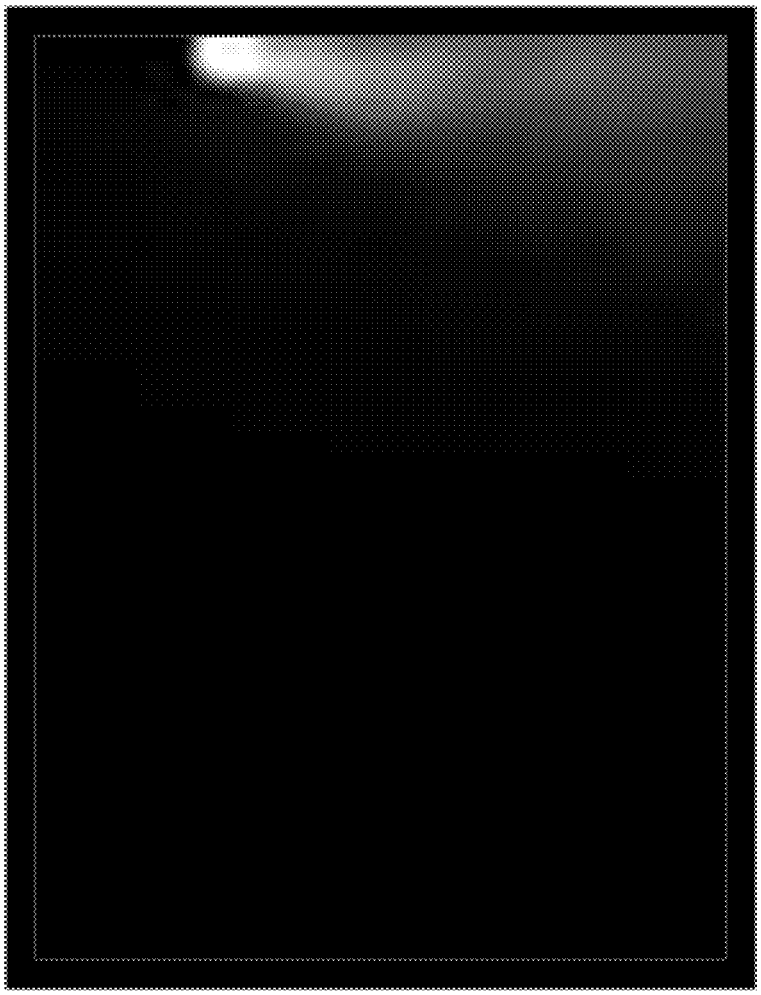
FIG. 8 is a view illustrating a phenomenon in which light of an auxiliary light source spreads to a main display unit in the always-on mode according to an embodiment of the present disclosure.

In the always-on mode, the auxiliary light source 22 is turned on and the main light source 20 is turned off, but light from the auxiliary light source 22 may irradiate the main display unit 10 as illustrated in FIG. 8. As a result, in the always-on mode, flicker may occur or touch sensitivity may be lowered in the main display unit 10 due to a leakage current of the main display unit 10. This will be described with reference to FIGS. 9 through 12.

Figure 9:
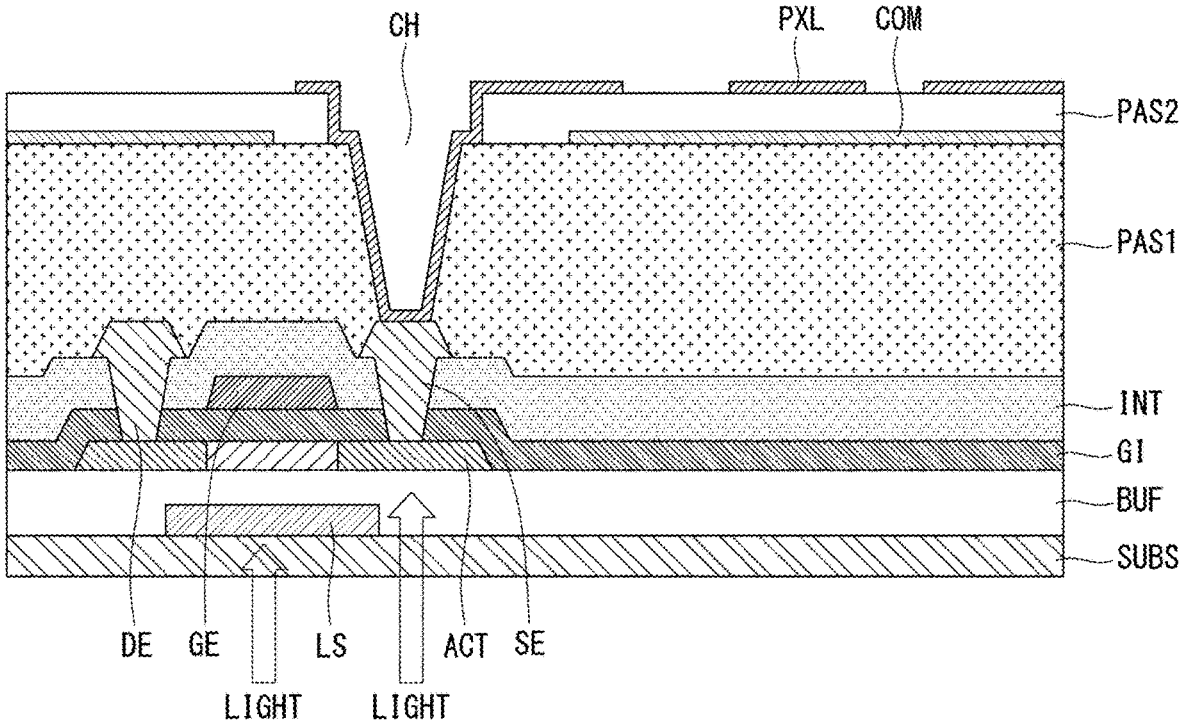
FIG. 9 is a cross-sectional view illustrating a structure of a pixel according to an embodiment of the present disclosure.
Figure 10:
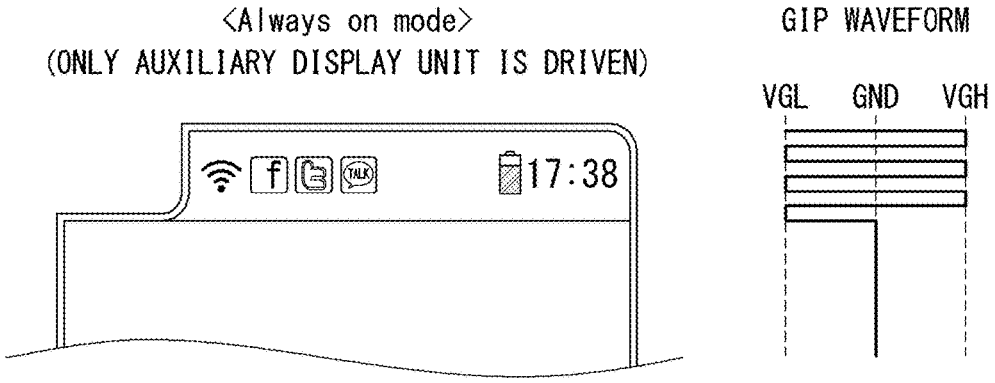
FIG. 10 is a view illustrating an example in which a ground voltage GND is applied to gate lines of a main display unit in the always-on mode according to an embodiment of the present disclosure.
Figure 11:
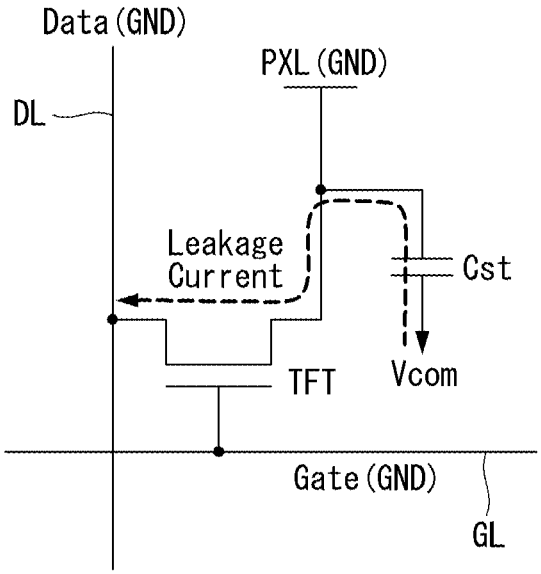
FIG. 11 is a circuit diagram illustrating a leakage current of a pixel according to an embodiment of the present disclosure.
Figure 12:
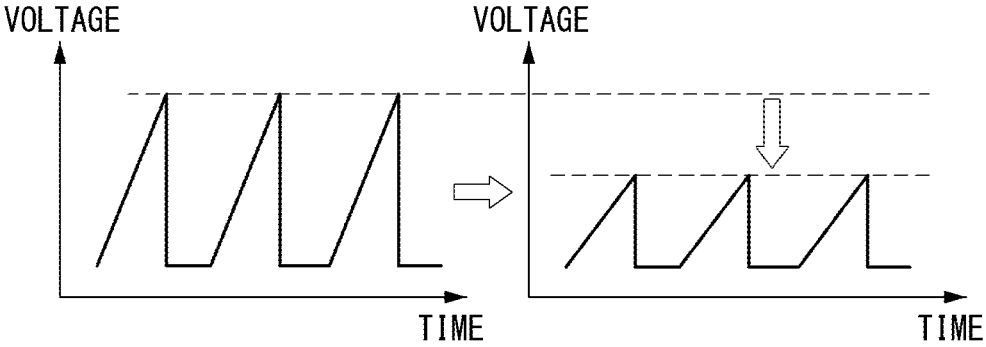
FIG. 12 is a waveform view illustrating a touch sensing voltage lowered due to a leakage current according to an embodiment of the present disclosure.

FIG. 9 is a cross-sectional view illustrating a structure of a pixel according to an embodiment of the present disclosure. FIG. 10 is a view illustrating an example in which a ground voltage GND is applied to the gate lines of the main display unit in the always-on mode. FIG. 11 is a circuit diagram illustrating a leakage current of a pixel according to an embodiment of the present disclosure. FIG. 12 is a waveform view illustrating a touch sensing voltage lowered due to a leakage current according to an embodiment of the present disclosure.

Referring to FIGS. 9 through 12, a lower plate of the display panel 100 includes a TFT array disposed on the substrate SUBS. The TFT array includes signal lines DL and GL, a TFT, a pixel electrode PXL, and a common electrode COM.

A light shield pattern LS is formed on the substrate SUBS, and a buffer insulating layer BUF is formed thereon. The light shield pattern LS is disposed below a channel region in a semiconductor pattern ACT of the TFT to block light incident through the substrate SUBS to prevent a leakage current of the TFT generated when the semiconductor pattern ACT is exposed due to light. The buffer insulating layer BUF is formed on the substrate SUBS to cover the light shield pattern LS. The light shield pattern LS is formed of a metal, and the buffer insulating layer BUF may be formed of an inorganic insulating material such as SiOx or SiNx.

The semiconductor pattern ACT is covered by a gate insulating layer GI. A gate metal pattern is formed on the gate insulating layer GI. The gate metal pattern includes a gate GE of the TFT and a gate line GL connected to the gate GE. The gate insulating layer GI may be formed of an inorganic insulating material such as SiOx or SiNx.

An interlayer insulating layer INT covers the gate metal pattern. The interlayer insulating layer INT may be formed of an inorganic insulating material such as SiOx or SiNx. A source-drain metal pattern is formed on the interlayer insulating layer INT. The source-drain metal pattern includes a data line DL and a source SE and drain DE of the TFT. The source SE and the drain DE of the TFT is in contact with the semiconductor pattern ACT of the TFT through a contact hole penetrating through the interlayer insulating layer INT and the gate insulating layer GI. The source SE of the TFT is connected to the pixel electrode PXL through a contact hole CH penetrating through passivation layers PAS1 and PAS2. The drain DE of the TFT is connected to the data line.

The first passivation layer covers the source-drain metal pattern. The second passivation layer PAS2 is formed on the first passivation layer PAS1. The common electrode COM is formed on the first passivation layer PAS1. The first and second passivation layers PAS1 and PAS2 are etched to form a contact hole CH. The pixel electrode PXL is formed on the second passivation layer PAS2. The common electrode COM and the pixel electrode PXL are formed of a transparent electrode material such as indium-tin-oxide (ITO). The second passivation layer PAS1 may be formed of an organic insulating material such as photoacryl. The second passivation layer PAS2 may be formed of an inorganic insulating material such as SiOx or SiNx.

The light shield pattern LS and the semiconductor pattern ACT may be misaligned due to a process variation. In this case, the semiconductor pattern ACT is exposed to light to cause a leakage current through the TFT. When the leakage current occurs, a voltage of the pixel electrode PXL is discharged to reach a ground voltage (e.g., GND=0V). This results in a voltage difference between the pixel electrode PXL and the common electrode COM to cause the pixel to flicker.

The leakage current of the TFT discharges the common electrode COM to lower a touch sensing voltage as illustrated in FIG. 12. As a result, a signal-to-noise ratio (SNR) of the touch sensing signal is lowered to cause defective touch recognition and degrade touch sensitivity.

Referring to FIG. 10, a gate pulse alternates between the VGH and VGL. In the always-on mode, the gate pulse is applied to the gate lines GL of the auxiliary display unit 12 to select pixels to which data is written. Meanwhile, the gate pulse is not applied to the gate lines GL of the main display unit 12, so the gate lines GL may be maintained at the ground voltage GND as illustrated in FIGS. 10 and 11. When the gate voltage of the TFT is a ground voltage GND, a leakage current is generated, and when the gate voltage of the TFT is a preset low voltage less than the ground voltage GND, the leakage current is reduced.

Figure 13:
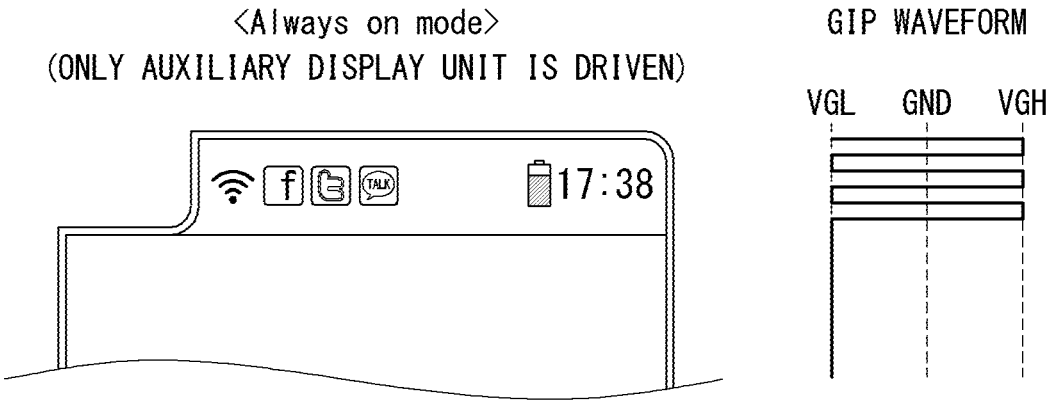
FIG. 13 is a view illustrating a method for controlling a gate voltage to prevent a leakage current according to an embodiment of the present disclosure.

In an embodiment of the present disclosure, in order to prevent the generation of the leakage current of the TFT, gate lines GL disposed in the main display unit 10 are driven with a preset low voltage such as a negative polarity voltage less than the ground voltage GND in the always-on mode. To this end, in an embodiment of the present disclosure, in the always-on mode, the gate low voltage VGL is supplied to the gate lines GL of the main display unit 10 through the main gate driver 40 as illustrated in FIG. 13. The preset voltage may be a negative polarity voltage such as VGL (e.g., a voltage of −9V). As a result, the gate of the TFT connected to the gate lines GL of the main display unit 10 maintains a VGL potential in the always-on mode, so a leakage current does not occur in the TFTs.

Figure 14:
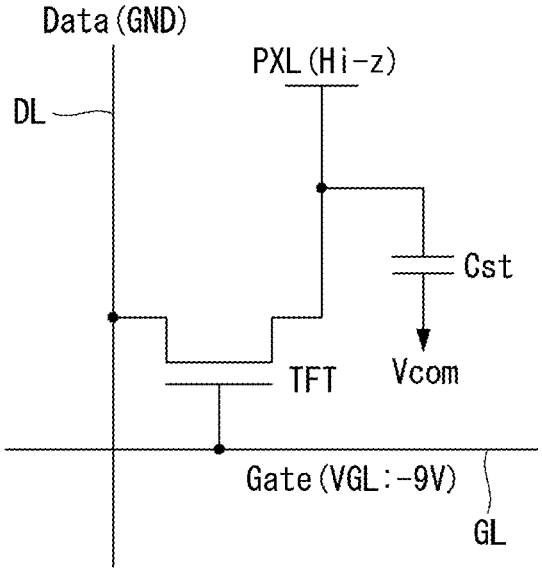
FIG. 14 is a circuit diagram illustrating a preset low voltage applied to gate lines of a main display unit in the always-on mode according to an embodiment of the present disclosure.

When a leakage current does not occur in the TFT, the pixel electrode PXL is in an impedance state (Hi-z) as illustrated in FIG. 14. When the pixel electrode PXL is floated to the high impedance (Hi-z) state, since the pixel electrode is coupled to the common electrode COM, a voltage difference with the common electrode COM may be reduced. Thus, in an embodiment of the present disclosure, since less light is transmitted in the pixels of the main display unit in the always-on mode, flickering may be prevented. In addition, in an embodiment of the present disclosure, since the touch sensing voltage is not lowered during the touch sensing period, a degradation of touch sensitivity and defective touch recognition may be prevented.

In the display device according to an embodiment of the present disclosure, since the auxiliary display unit 12 is driven in the always-on mode, power consumption occurs. In an embodiment of the present disclosure, power consumption in the always-on mode is reduced in various manners as described in the following embodiment.

Figure 15:
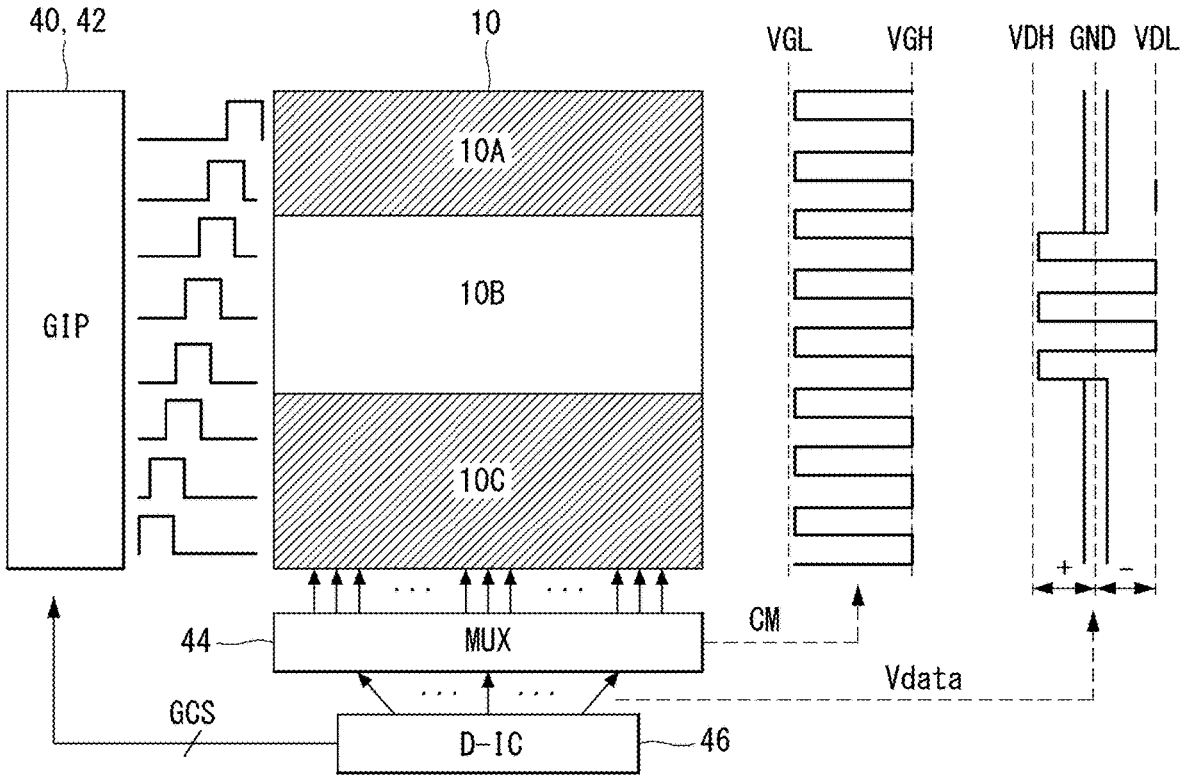
FIG. 15 is a view illustrating an output signal from a display panel driving circuit according to an embodiment of the present disclosure.
Figure 16:
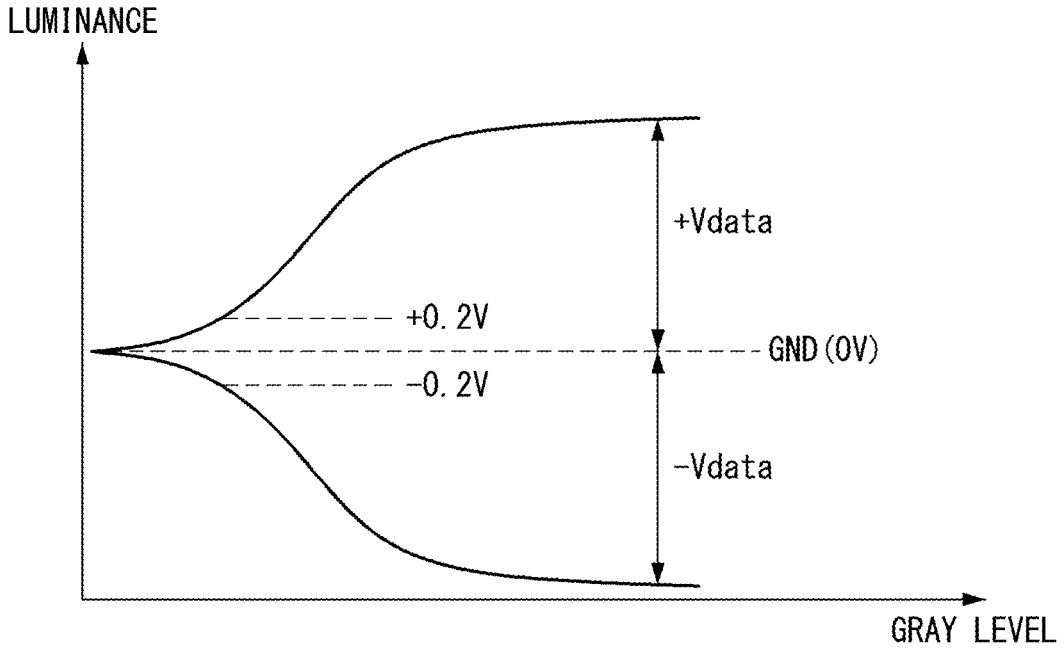
FIG. 16 is a view illustrating a positive polarity data voltage and a negative polarity data voltage in a gamma curve according to an embodiment of the present disclosure.

FIG. 15 is a view illustrating an example in which an image is displayed only in a portion of a screen of the display panel 100 according to an embodiment of the present disclosure. FIG. 16 is a view illustrating a positive polarity data voltage and a negative polarity data voltage in a gamma curve according to an embodiment of the present disclosure.

Referring to FIGS. 15 and 16, in order to write data into pixels of a portion of the screen, the data driver of the drive IC 46 outputs a data voltage Vdata to the data lines. In response to a MUX selection signal CM, the TFTs M1 to M3 of the multiplexer 44 are continuously switched during a frame period. In response to the MUX selection signal CM, the TFTs M1 to M3 are repeatedly turned on and off during 1 frame period. The MUX selection signal CM is generated as an AC signal alternating between the VGH and VGL signals.

The gate drivers 40 and 42 sequentially output gate pulses synchronized with a data voltage. Data voltages supplied to adjacent pixels have the opposite polarities. Thus, a positive polarity data voltage +Vdata and a negative polarity data voltage −Vdata are alternately supplied to the data lines DL. The positive polarity data voltage +Vdata is a voltage from +0.2V to a maximum positive polarity voltage VDH. The negative polarity data voltage −Vdata is a voltage from −0.2V to the maximum negative polarity voltage VDL.

Data corresponding to a white gray level (e.g., a gray level of 255) is written to pixels of a display region 10B. In the non-display areas 10A and 10C, the pixels do not have data, and thus, the pixels are provided with a data voltage of a black gray level. The black gray level corresponds to a gray level of 0 (zero). A positive polarity data voltage corresponding to gray level 0 is +0.2V, and a negative polarity data voltage corresponding to the gray level 0 is −0.2V. Although there is no data of an input image displayed in the non-display areas 10A and 10C, a gate pulse and a data voltage are supplied to the pixels of the non-display areas 10A and 10C so that data of a gray level 0 is written. Thus, the drive IC 46, the multiplexer 44, and the gate drivers 40 and 42 generate an output at a driving time of the non-display areas 10A and 10C, resulting in power consumption.

Figure 17:
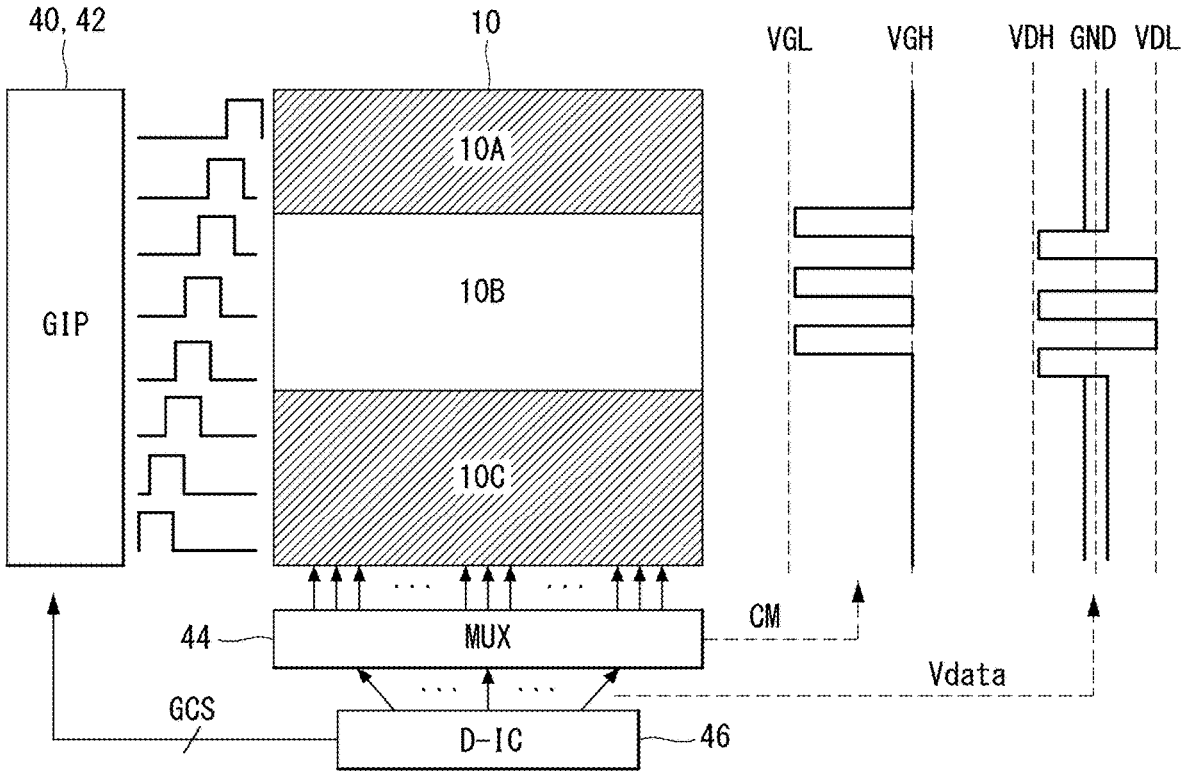
FIG. 17 is a view illustrating a method for driving a display device according to a first embodiment of the present disclosure.

FIG. 17 is a view illustrating a method for driving a display device according to a first embodiment of the present disclosure.

Referring to FIG. 17, in an embodiment of the present disclosure, in order to reduce power consumption, the MUX selection signal CM is fixed to a VGH potential during a driving period of the non-display areas 10A and 10C. A DC voltage having the VGH potential is supplied to gates of the TFTs M1 to M3 of the multiplexer 44 during the driving period of the non-display areas 10A and 10C. The VGH is an on-level voltage at which the TFTs M1 to M3 are turned on. The TFTs M1 to M3 remain in the ON state during the driving period of the non-display areas 10A and 10C to transmit a data voltage from the driver IC 46 to the data lines DL. Since the MUX selection signal CM is fixed to the VGH potential as an on-level voltage of the TFTs, there is no current consumption in the TFTs M1 to M3 of the multiplexer 44 during the driving period of the non-display areas 10A and 10C, thus reducing power consumption.

In the full display mode, the multiplexer 44 distributes a data voltage to several data lines in a time division manner during the driving period of the display area 10B, and thus, the MUX selection signal CM is generated as an AC signal. In the full display mode, the TFTs M1 to M3 of the multiplexer 44 are repeatedly turned on and off during the driving period of the display area 10B to distribute the data voltage to the data lines. In the full display mode, the MUX selection signal CM is fixed to the VGH potential during the driving period of the non-display areas 10A and 10C. Thus, in an embodiment of the present disclosure, since the MUX selection signal CM is generated as a DC voltage during the driving period of the non-display areas 10A and 10C in the full display mode, power consumption may be reduced.

In the always-on mode, the main display unit 10 is a non-display area. Thus, in the always-on mode, the MUX selection signal CM is fixed to the VGH potential during a driving period of the main display unit 10, and is generated in the form of a pulse during a driving period of the auxiliary display unit 12. Thus, in an embodiment of the present disclosure, since the MUX selection signal CM is generated as an ON level voltage (DC voltage) during the driving period of the main display unit 10 in the always-on mode, power consumption may be reduced.

The drive IC 46 may include an image analyzing unit analyzing data of an input image to determine a non-display area without an input image and a display area in which an input image is displayed in the auxiliary display unit 12. The timing controller generates the MUX selection signal CM as a DC voltage during a driving period of the non-display area, and generates the MUX selection signal CM as an AC signal during a driving period of the display area.

Figure 18:
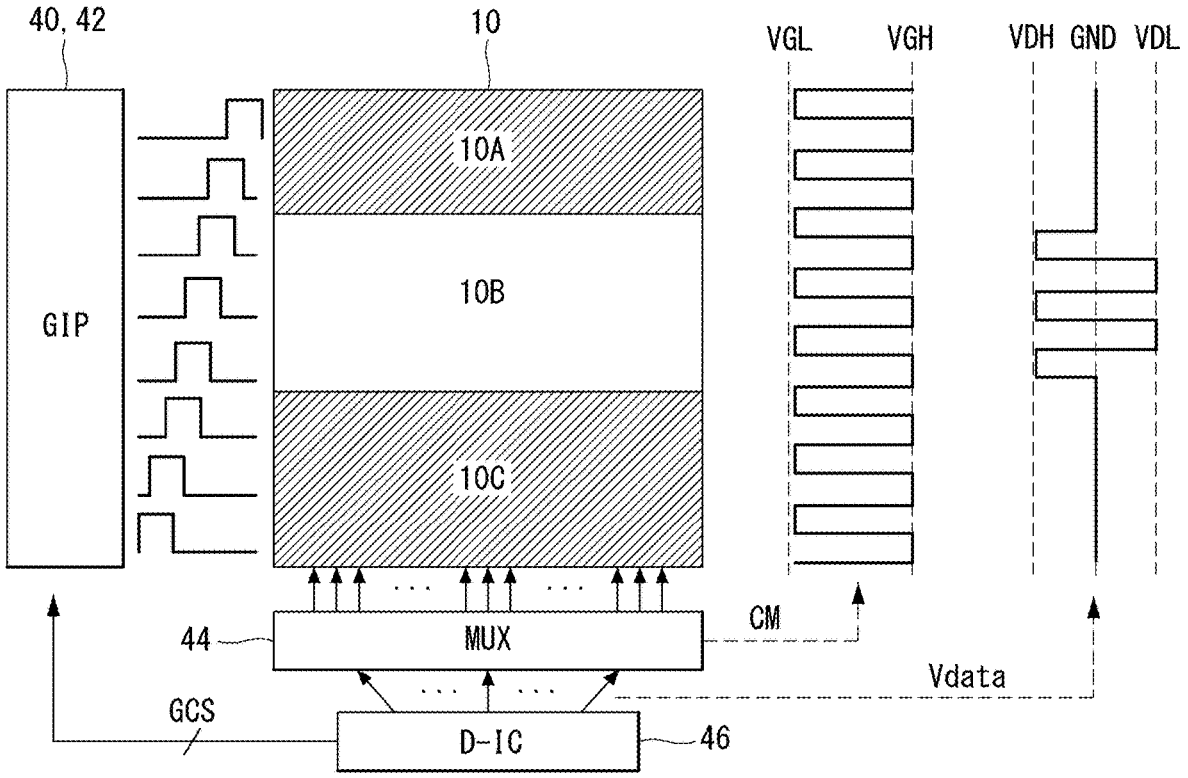
FIG. 18 is a view illustrating a method for driving a display device according to a second embodiment of the present disclosure.

FIG. 18 is a view illustrating a method for driving a display device according to a second embodiment of the present disclosure.

Referring to FIG. 18, in an embodiment of the present disclosure, in order to reduce power consumption, the data voltage Vdata is fixed to a ground voltage (e.g., GND=0V) during the driving period of the non-display areas 10A and 10C. Since a data voltage does not alternate during the driving period of the non-display areas 10A and 10C, power consumption does not occur. The ground voltage GND is a voltage corresponding to a black gray level, and the pixels of the non-display areas 10A and 10C display a black image. Thus, in an embodiment of the present disclosure, the data voltage Vdata is fixed to the ground voltage (e.g., GND=0V) during the driving period of the non-display areas 10A and 10C in the full display mode, and thus, power consumption may be reduced.

During the driving period of the display area 10B, a voltage level of the data voltage is changed according to data of an input image, and in order to implement dot inversion of pixels, polarity thereof is inverted between successive horizontal periods. Thus, during the driving period of the display area 10B, the data voltage is generated as an AC voltage alternating between a positive polarity voltage and a negative polarity voltage. During a horizontal period, data voltage is charged to pixels disposed in one line of the display panel 100.

In the always-on mode, the main display unit 10 is a non-display area. In the always-on mode, the data voltage Vdata is fixed to a ground voltage (e.g., GND=0V) during a driving period of the main display unit 10. In the always-on mode, the voltage level of the data voltage Vdata is changed according to data of an input image and polarity thereof is inverted between successive horizontal periods during a driving period of the auxiliary display unit 12. Thus, in an embodiment of the present disclosure, the data voltage Vdata is fixed to the ground voltage (e.g., GND=0V) during the driving period of the main display unit 10, thus reducing power consumption.

The drive IC 46 may include an image analyzing unit analyzing data of an input image to determine the non-display areas 10A and 10C without an input image and the display area 10B in which an input image is displayed in the auxiliary display unit 12. The drive IC 46 fixes the data voltage Vdata to the ground voltage (e.g., GND=0V) during the driving period of the non-display areas 10A and 10C.

Figure 19:
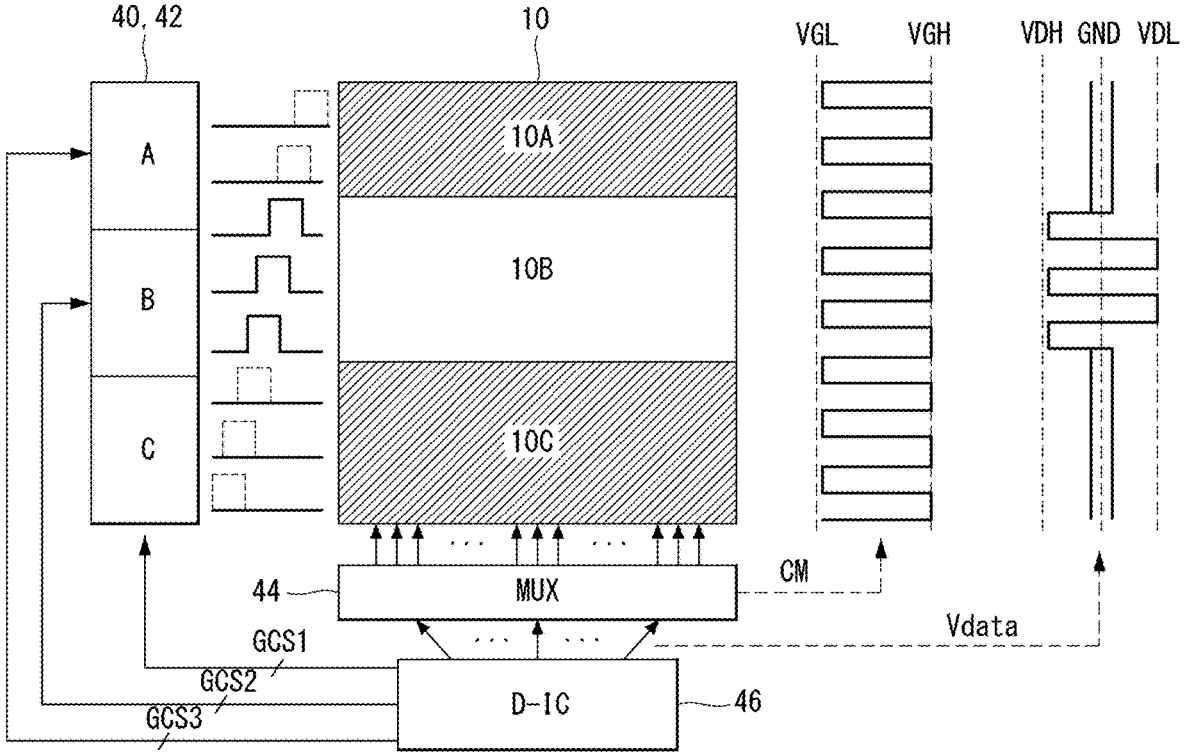
FIG. 19 is a view illustrating a method for driving a display device according to a third embodiment of the present disclosure.

FIG. 19 is a view illustrating a method for driving a display device according to a third embodiment of the present disclosure.

Referring to FIG. 19, in an embodiment of the present disclosure, in order to reduce power consumption, the gate drivers 40 and 42 are divided into a plurality of blocks A, B, and C and driven individually.

The gate drivers 40 and 42 sequentially shift a gate pulse applied to the gate lines by using a shift register. When the drive IC 46 inputs a gate start pulse GSP, the shift register shifts an output according to the gate shift clock GSC timing. The shift register includes a plurality of stages (or D flip flops) connected independently. The stages, starting from one to which the gate start pulse GSP is input, generate an output.

The drive IC 46 determines the non-display areas 10A and 10C without an input image and the display area 10B in which an input image is displayed in the main display unit 10 and the auxiliary display unit 12 by using the input image analyzing unit. The timing controller of the drive IC 46 generates gate timing control signals GCS1, GCS2, and GCS3 for controlling the gate drivers 40 and 42, and controls output of the gate drivers 40 and 42. The timing controller separates the gate timing control signals on the basis of an input image analysis result. The timing controller generates gate timing control signals GCS1 and GCS3 for controlling a gate pulse output of the non-display areas 10A and 10C and a gate timing control signal GCS2 for controlling a gate pulse output of the display area 10B.

A gate timing control signal, such as GCS1, GCS2, and GCS3, includes a gate start pulse GSP, a gate shift clock GSC, and a gate output enable signal GOE. In the case of a GIP circuit, the gate output enable signal GOE may be omitted. The gate start pulse GSP controls an output start timing of a first gate pulse in a block of the gate drivers 40 and 42 (e.g., block A, B, or C). The gate shift clock GCS is input to the shift register to control a shift timing of the shift register. The gate output enable signal GOE defines an output timing of the gate pulse.

In the example of FIG. 19, the first and third gate timing control signals GCS1 and GCS3 control gate pulse outputs of the non-display areas 10A and 10C. The second gate timing control signal GCS2 controls a gate pulse output of the display area 10B. The first and third gate timing control signals GCS1 and GCS3 are generated as signals without a gate start pulse GSP or a gate shift clock GSC. Meanwhile, the second gate timing control signal GCS2 includes the gate start pulse GSP and the gate shift clock GSC.

The gate drivers 40 and 42 are divided into a plurality of blocks individually driven according to the gate timing control signals GCS1 to GCS3. A start position of a block A, B, or C is determined by the gate start pulse GSP timing. Thus, a size and a position of a block A, B, or C may be varied according to the gate start pulse timing.

In the example of FIG. 19, a shift register of the first block A outputs a gate pulse in response to the third gate timing control signal GCS3. A shift register of the second block B outputs a gate pulse in response to the second gate timing control signal GCS2. A shift register of the third block C outputs a gate pulse in response to the first gate timing control signal GCS1. Since the gate start pulse GSP or the gate shift clock GCS are not present in the first and third gate timing control signals GCS1 and GCS3, the first and third blocks A and C do not output a gate pulse. In contrast, since the second gate timing control signal GCS2 includes the gate start pulse GSP and the gate shift clock GSC, the stages of the second block B may sequentially output a gate pulse. Thus, the gate lines GL of the non-display areas 10A and 10C maintain the VGL potential. Meanwhile, the gate lines GL of the display area 10B output gate pulses that rise to the VGH and fall to the VGL. In response to the gate pulses, the TFTs supply the data voltage Vdata to the pixel electrode, and thus, only the pixels of the display area 10B charge the data voltage Vdata.

In an embodiment of the present disclosure, in the full display mode, the gate pulse is not output during the driving period of the non-display areas 10A and 10C, and the voltage of the gate lines of the non-display areas 10A and 10C is maintained at the VGL potential. Thus, in an embodiment of the present disclosure, power consumption is reduced in the full display mode.

In the always-on mode, the main display unit 10 is a non-display area. Thus, in the always-on mode, the gate driver 40 does not output any gate pulses during a driving period of the main display unit 10. In the always-on mode, the gate driver 42 supplies a gate pulse to the gate lines during a driving period of the auxiliary display unit 12. Thus, in an embodiment of the present disclosure, since the gate driver 40 does not output a gate pulse during the driving period of the main display unit 10 in the always-on mode, power consumption may be reduced.

Figure 20:
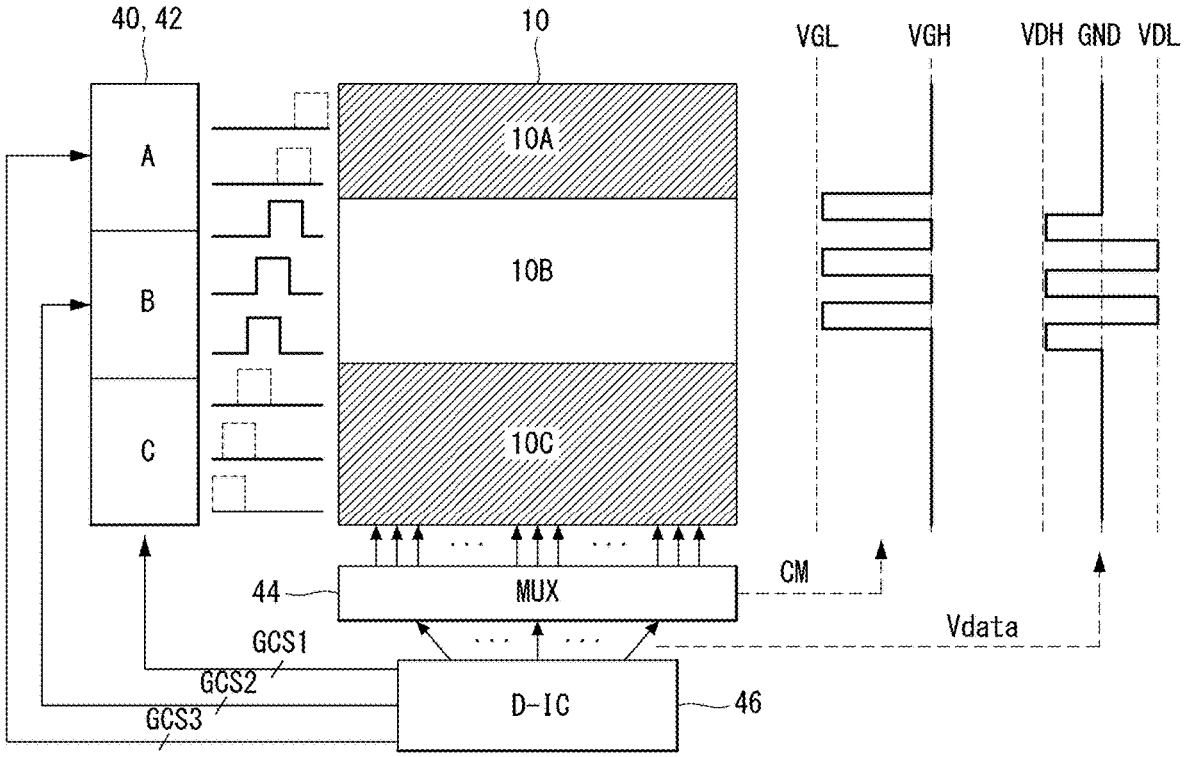
FIG. 20 is a view illustrating a method for driving a display device according to a fourth embodiment of the present disclosure.

The embodiments for reducing power consumption may be applied together. For example, two or more of the driving methods of FIGS. 17 through 19 may be applied together. FIG. 20 illustrates an example in which all of the driving methods of FIGS. 17 through 19 are applied. In this embodiment, power consumption of the display device may be controlled to have a minimum level.

FIG. 21 is a view illustrating a method for driving a display device according to a fifth embodiment of the present disclosure.

Referring to FIG. 21, in an embodiment of the present disclosure, in order to reduce power consumption, a memory of the drive IC 46 is divided into a plurality of blocks 61 to 63, which may be independently driven.

A memory controller 50 independently drives the blocks 61 to 63 defined for the non-display areas 10A and 10C and the display area 10C defined according to an input image analysis result. The memory controller 50 reads data from memory and writes data into memory by inputting a memory driving voltage and read/write clocks to the memory. The memory controller 50 individually controls the memory by blocks using the memory driving voltage and the read/write clocks.

In the example of FIG. 21, the first block 61 of the memory stores data to be written into the pixels of the first non-display area 10A. The second block 62 of the memory stores data to be written into pixels of the display area 10B. The third block 63 stores data to be written into pixels of the second non-display area 10C. The memory power switching units 51 to 53 individually supply a memory driving voltage to the blocks 61 to 63 under the control of the memory controller 50.

The memory controller 50 does not supply a memory driving voltage and a clock to the first and third blocks 61 and 63 of the memory during a driving period of the non-display areas 10A and 10C. As a result, the first and third blocks 61 and 63 of the memory are not driven during the non-display driving period and do not consume power. Meanwhile, the memory controller 50 supplies a memory driving voltage and a clock to the second block 62 of the memory during a driving period of the display area 10B to write data of the input image and read data of the input image. In an embodiment of the present disclosure, only a partial area of the memory storing data to be displayed in the display region 10B is driven in the full display mode, thus reducing power consumption.

In the always-on mode, the main display unit 10 is a non-display area. Thus, in an embodiment of the present disclosure, only a partial area of the memory storing data to be displayed on the auxiliary display unit 12 is driven in the always-on mode, thus reducing power consumption.

Figure 22:
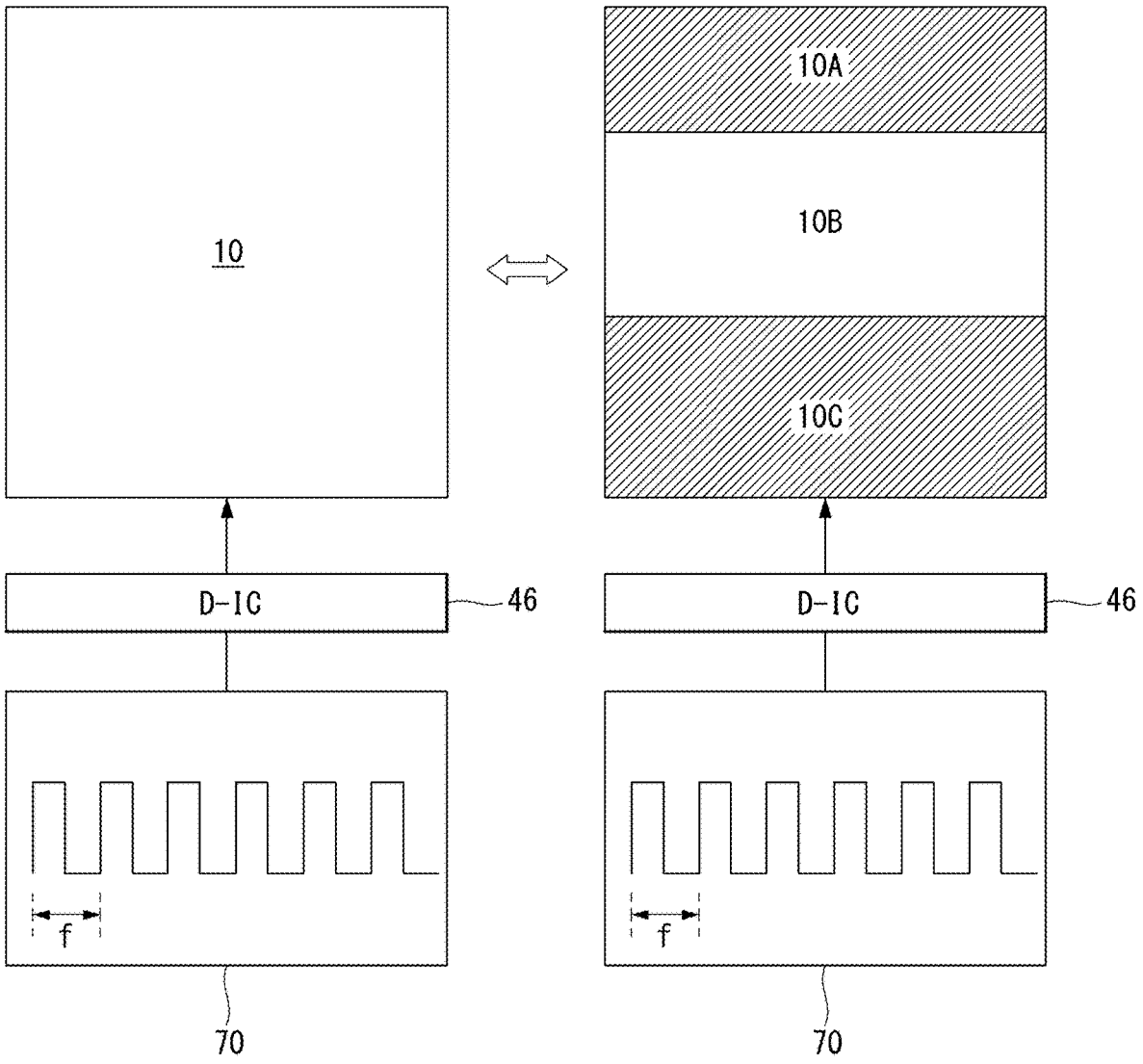
FIG. 22 is a view illustrating a reference frequency fixed regardless of amount of data according to an embodiment of the present disclosure.

FIG. 22 is a view illustrating a reference frequency fixed regardless of amount of data according to an embodiment of the present disclosure. FIG. 23 is a view illustrating a method for driving a display device according to a sixth embodiment of the present disclosure.

Referring to FIG. 22, a reference frequency generated by a reference frequency generating unit 70 determines a frame rate, and determines a step-up frequency of a DC-DC converter. In general, a frame rate and a step-up frequency of the DC-DC converter are fixed, regardless of data load. Thus, when the reference frequency is fixed as illustrated in FIG. 22, even though an amount of data to be displayed in the pixel array of the display panel is small, the DC-DC converter consumes at least a predetermined amount of power.

In an embodiment of the present disclosure, when the non-display areas 10A and 10C have a size equal to or greater than a preset size in the full play mode, the reference frequency f is lowered to lower the frame rate or a driving voltage of the display panel 100 as illustrated in FIG. 23. The driving voltage of the display panel 100 output from the DC-DC converter is proportional to a step-up frequency. Thus, when the reference frequency f is changed, an output voltage of the DC-DC converter is lowered. For example, when an amount of data to be displayed on the display panel 100 is reduced due to the non-display areas 10A and 10C, the reference frequency is lowered to f/2 and the DC-DC converter lowers the positive polarity and negative polarity gamma voltages VDH and VDL to reduce a voltage range of the data voltage Vdata, thus reducing power consumption.

In an embodiment of the present disclosure, when the non-display areas 10A and 10C have a size greater than the preset size in the full display mode, the reference frequency may be reduced to decrease a frame rate of the display device. The frame rate determines an update period of data written into pixels. For example, when the reference frequency is lowered to f/2, the frame rate is reduced by a factor of ½. When a frame rate is 60 Hz in a case in which a non-display area is not present on the screen of the display panel, the frame rate is lowered to 30 Hz due to the presence of the non-display areas 10A and 10C. A driving frequency of the drive IC 46 and the gate drivers 40 and 42 is proportional to the frame rate. When the frame rate is lowered, a frame period increases to reduce a data update period of pixels, and thus, the driving frequency of the drive IC 46 and the gate driver is reduced. Thus, in an embodiment of the present disclosure, when an amount of data to be displayed in the pixels is reduced in the full display mode, the frame rate may be decreased to reduce power consumption.

In the always-on mode, the main display unit 10 is a non-display area. The reference frequency is further reduced when transitioning to the always-on mode from the full display mode. Thus, in an embodiment of the present disclosure, the reference frequency is reduced in the always-on mode to decrease a driving voltage and/or a frame rate of the display panel 100 to reduce power consumption.

The reference frequency control unit 72 controls the reference frequency output from the reference frequency generating unit 70 in response to a mode (MODE) signal from the host system HOST 200 or an output from the image analyzing unit. The image analyzing unit analyzes data of an input image and determines the non-display areas 10A and 10C without an input image and the display area 10B in which an input image is displayed in the main display unit 10 and the auxiliary display unit 12. The reference frequency generating unit 70, the reference frequency control unit 72, and the image analyzing unit may be installed in the drive IC 46.

Figure 24:
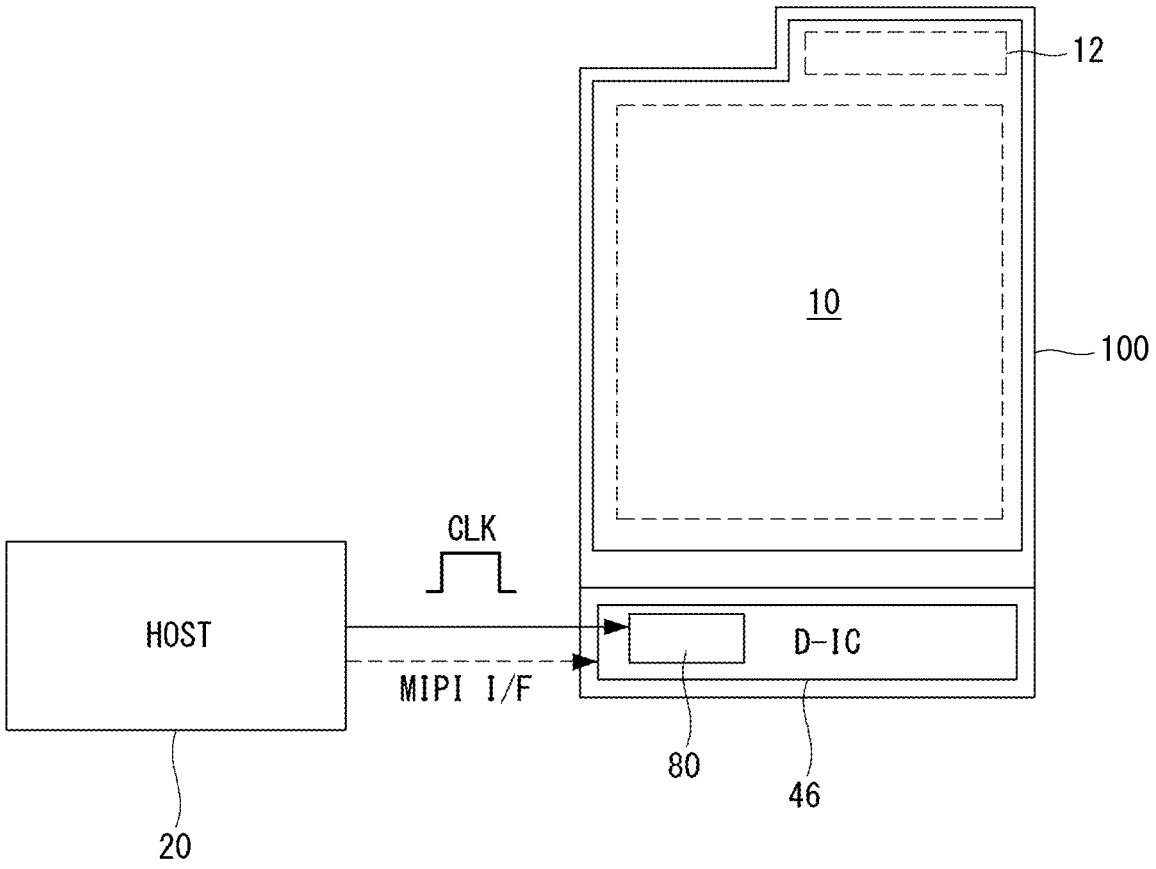
FIG. 24 is a view illustrating a method for driving a display device according to a seventh embodiment of the present disclosure.

FIG. 24 is a view illustrating a method for driving a display device according to a seventh embodiment of the present disclosure.

Referring to FIG. 24, in the mobile terminal, an application processor (AP) of the host system 200 transmits and receives image data to and from the display device through a mobile industry processor interface (MIPI). In a case in which simple information such as a clock, or the like, is displayed on an idle screen of an existing mobile terminal, a transmitter and a receiver of the MIPI transmit and receive a clock and other watch data, consuming power.

In an embodiment of the present disclosure, in order to reduce power consumption, when watch information is displayed in the auxiliary display area 12 in the always-on mode, and no other information is communicated through the MIPI for display, a separate clock is used by the drive IC 46 to generate watch data for display by the auxiliary display unit 12, rather than using watch data communicated through the MIPI interface. The drive IC 46 generates watch data by using an internal data generating unit 80. The internal data generating unit 80 includes a counter memory and a font memory. The internal data generating unit 80 generates watch data with font data read from the font memory, and updates the watch data by counting a clock received from the host system HOST 200. The watch data from the internal data generating unit 80 is displayed on the auxiliary display unit 12. Thus, in a case in which watch data but no other information communicated through the MIPI is displayed on the auxiliary display unit 12, the MIPI does not consume power because transmitter and the receiver of the MIPI interface do not operate.

Content displayed on the auxiliary display unit 12 may include data to be generated in the host system, for example, a communication state, a battery power state, or an SNS message. In this case, data of the content to be displayed on the auxiliary display unit 12 is transmitted to the drive IC 46 of the display device through the MIPI interface.

As described above, according to the embodiment of the present disclosure, the main display unit and the auxiliary display unit are divided for independent driving, and in the always-on mode, information selected by the user (or for display to the user) is displayed on the auxiliary display unit.

The auxiliary display unit may constantly display information in some embodiments of the always-on mode.

Also, according to the embodiment of the present disclosure, by fixing a voltage of the gate lines disposed in the main display unit to a preset low voltage, such as a negative polarity voltage, in the always-on mode, information may be displayed on the auxiliary display unit while reducing flicker in a non-display region and overall power consumption while improving touch sensitivity.

What is claimed is:

1. A display device comprising:

a display panel in which pixel arrays include pixels that are disposed in a matrix form according to an intersection structure of data lines and gate lines, the pixel arrays divided into a main display unit and an auxiliary display unit both on a common substrate;

a data driver configured to supply a data voltage to the data lines;

a first gate driver connected to gate lines of the main display unit; and a second gate driver connected to gate lines of the auxiliary display unit, wherein, in a full display mode, the first gate driver supplies first gate pulses to the gate lines of the main display unit and the second gate driver supplies second gate pulses to the gate lines of the auxiliary display unit, and in an always-on mode, the first gate driver fixes a voltage of the gate lines of the main display unit to a negative polarity voltage less than a ground voltage during an entire duration of the always-on mode, and the second gate driver supplies the second gate pulses to the gate lines of the auxiliary display unit.

2. The display device of claim 1, wherein one or more of the data lines are connected to the pixels of both the main display unit and the auxiliary display unit.

3. The display device of claim 1, wherein the first gate pulses and the second gate pulses each alternate between a first gate voltage and a second gate voltage that is less than the ground voltage and the first gate voltage.

4. The display device of claim 1, further comprising:

a multiplexer comprising switching elements configured to distribute the data voltage to the data lines, the switching elements switched on and off in response to a selection signal, wherein, in the always-on mode, the selection signal is fixed to a direct current (DC) voltage during a driving period of the main display unit and is generated as an alternating current (AC) voltage during a driving period of the auxiliary display unit, and the switching elements of the multiplexer are maintained in an ON state during the driving period of the main display unit in response to the DC voltage of the selection signal.

5. The display device of claim 4, further comprising:

an image analyzing unit configured to analyze data of an input image to determine a non-display area without the input image and a display area in which the input image is displayed in the main display unit and the auxiliary display unit, wherein, in the full display mode, the selection signal is fixed to the DC voltage during a driving period of the non-display area and fixed to the AC voltage during a driving period of the display area, and the switching elements of the multiplexer are maintained in the ON state during the driving period of the non-display area in response to the DC voltage of the selection signal.

6. The display device of claim 1, wherein, in the always-on mode, the data driver fixes the data voltage to the ground voltage during a driving period of the main display unit and generates the data voltage as an AC voltage during a driving period of the auxiliary display unit.

7. The display device of claim 6, further comprising:

an image analyzing unit configured to analyze data of an input image to determine a non-display area without the input image and a display area in which the input image is displayed in the main display unit and the auxiliary display unit, wherein, in the full display mode, the data driver fixes the data voltage to the ground voltage during a driving period of the non-display area and generates the data voltage as the AC voltage during a driving period of the display area.

8. The display device of claim 1, wherein, in the always-on mode, the second gate driver generates the second gate pulses only during a driving period of the auxiliary display unit, and the first gate driver does not generate the first gate pulses during the driving period of the main display unit.

9. The display device of claim 8, further comprising:

an image analyzing unit configured to analyze data of an input image to determine a non-display area without the input image and a display area in which the input image is displayed in the main display unit and the auxiliary display unit, wherein, in the full display mode, the first gate driver generates the first gate pulses and the second gate driver generates the second gate pulses only during a driving period of the display area.

10. The display device of claim 1, further comprising:

a multiplexer comprising switching elements configured to distribute the data voltage to the data lines, the switching elements switched on and off in response to a selection signal, wherein, in the always-on mode, the selection signal is fixed to a DC voltage during a driving period of the main display unit and is generated as an AC voltage during a driving period of the auxiliary display unit, the switching elements of the multiplexer are maintained in an ON state during the driving period of the main display unit in response to the DC voltage of the selection signal, the data driver fixes the data voltage to the ground voltage during the driving period of the main display unit and generates the data voltage as an AC voltage during the driving period of the auxiliary display unit in the always-on mode, and the second gate driver generates the gate pulses only during the driving period of the auxiliary display unit in the always-on mode, and the first gate driver does not generate any gate pulses during the driving period of the auxiliary display unit.

11. The display device of claim 10, further comprising:

an image analyzing unit configured to analyze data of an input image to determine a non-display area without the input image and a display area in which the input image is displayed in the main display unit and the auxiliary display unit, wherein, in the full display mode, the selection signal is fixed to the DC voltage during a driving period of the non-display area and generated as an AC voltage during a driving period of the display area, the switching elements of the multiplexer are maintained in the ON state during the driving period of the non-display area in response to the DC voltage of the selection signal, the data driver fixes the data voltage to the ground voltage during the driving period of the non-display area and generated as an AC voltage during the driving period of the display area in the full display mode, and the first gate driver and the second gate driver generate the gate pulses only during the driving period of the display area in the full display mode.

12. The display device of claim 1, further comprising:

a memory configured to store data to be displayed on the main display unit and the auxiliary display unit; and a memory controller configured to drive only a partial area of the memory in the always-on mode, the partial area of the memory storing data to be displayed on the auxiliary display unit.

13. The display device of claim 12, further comprising:

an image analyzing unit configured to analyze data of an input image to determine a non-display area without the input image and a display area in which the input image is displayed in the main display unit and the auxiliary display unit, wherein the memory controller is configured to drive only a partial region of the memory in the full display mode, the partial region of the memory storing data to be displayed in the display area.

14. The display device of claim 1, further comprising:

a reference frequency generating unit configured to generate a reference frequency;

a DC-DC converter configured to generate a driving voltage of the display panel including a data voltage and a voltage of a gate pulse on the basis of the reference frequency; and a reference frequency control unit configured to reduce the reference frequency in response to transitioning to the always-on mode from the full display mode, thereby lowering an output voltage of the DC-DC converter.

15. The display device of claim 14, further comprising:

an image analyzing unit configured to analyze data of an input image to determine a non-display area without the input image and a display area in which the input image is displayed in the main display unit and the auxiliary display unit, wherein the reference frequency control unit is configured to reduce the reference frequency, thereby reducing an output voltage of the DC-DC converter when the non-display area is greater than a preset area in the full display mode.

16. The display device of claim 1, further comprising:

a mobile industry processor interface (MIPI) capable of communicating to receive watch data for display; and an internal data generating unit configured to generate the watch data without communication through the MIPI, wherein the watch data generated by the internal data generating unit is displayed on the auxiliary display unit.

17. The display device of claim 1, wherein the display panel has a concavely indented corner portion having an internal angle greater than 180° and less than or equal to 300°, and the auxiliary display unit is disposed between two corner portions including the concavely indented corner portion.

18. The display device of claim 17, further comprising a backlight unit configured to irradiate light to the display panel, wherein the backlight unit comprises:

a main light source configured to irradiate light to the main display unit; and an auxiliary light source disposed in a space secured by the concavely indented corner portion to irradiate light to the auxiliary display unit.

19. A display driver for a display panel in which pixel arrays include pixels disposed in a matrix form according to an intersection structure of data lines and gate lines, the pixel arrays divided into a main display unit and an auxiliary display unit both on a common substrate, the display driver comprising:

a data driver configured to supply a data voltage to the data lines;

a first gate driver connected to gate lines of the main display unit; and a second gate driver connected to gate lines of the auxiliary display unit, wherein, in a full display mode, the first gate driver supplies first gate pulses to the gate lines of the main display unit and the second gate driver supplies second gate pulses to the gate lines of the auxiliary display unit, and in an always-on mode, the first gate driver fixes a voltage of the gate lines of the main display unit to a negative polarity voltage less than a ground voltage during an entire duration of the always-on mode, and the second gate driver supplies the second gate pulses to the gate lines of the auxiliary display unit.

20. The display driver of claim 19, further comprising:

a multiplexer comprising switching elements configured to distribute the data voltage to the data lines, the switching elements switched on and off in response to a selection signal, wherein, in the always-on mode, the selection signal is fixed to a direct current (DC) voltage during a driving period of the main display unit and is generated as an alternating current (AC) voltage during a driving period of the auxiliary display unit, and the switching elements of the multiplexer are maintained in an ON state during the driving period of the main display unit in response to the DC voltage of the selection signal.

21. The display driver of claim 19, wherein, in the always-on mode, the data driver fixes the data voltage to the ground voltage during a driving period of the main display unit and generates the data voltage as an AC voltage during a driving period of the auxiliary display unit.

22. The display driver of claim 19, wherein, in the always-on mode, the second gate driver generates the second gate pulses only during a driving period of the auxiliary display unit, and the first gate driver does not generate the first gate pulses during the driving period of the auxiliary display unit.

23. The display driver of claim 19, wherein the main display unit and the auxiliary display unit are non-overlapping and in the full display mode, the auxiliary display unit displays a first image, and the main display unit does not display an image, and wherein in the always-on mode, the auxiliary display unit displays the first image that was also displayed during the full display mode, and the main display unit displays a second image that is different from the first image.

24. The display device of claim 1, wherein the main display unit and the auxiliary display unit are non-overlapping and in the full display mode, the auxiliary display unit displays a first image, and the main display unit does not display an image, and wherein in the always-on mode, the auxiliary display unit displays the first image that was also displayed during the full display mode, and the main display unit displays a second image that is different from the first image.

* * * * *